US006927765B1

(12) United States Patent
Masazumi et al.

(10) Patent No.: US 6,927,765 B1
(45) Date of Patent: Aug. 9, 2005

(54) LIQUID CRYSTAL DISPLAY DEVICE AND DRIVING METHOD THEREOF

(75) Inventors: Naoki Masazumi, Kobe (JP); Eiji Yamakawa, Sanda (JP); Hideo Hotomi, Nishinomiya (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/438,885

(22) Filed: Nov. 12, 1999

(30) Foreign Application Priority Data

Nov. 17, 1998 (JP) ..... 10-326387
Dec. 1, 1998 (JP) ..... 10-341918

(51) Int. Cl.[7] ..... G09G 3/36
(52) U.S. Cl. ..... 345/204; 345/87; 345/95; 345/210; 349/169; 349/179
(58) Field of Search ..... 345/87, 95, 204, 345/210; 349/169, 179

(56) References Cited

U.S. PATENT DOCUMENTS 5,251,048 A * 10/1993 Doane et al. ..... 345/87
5,274,484 A * 12/1993 Mochizuki et al. ..... 349/33
5,384,067 A * 1/1995 Doane et al. ..... 252/299.01
5,598,229 A * 1/1997 Okada et al. ..... 348/792
5,748,277 A * 5/1998 Huang et al. ..... 349/169
5,933,203 A * 8/1999 Wu et al. ..... 349/35
5,963,190 A * 10/1999 Tsuboyama et al. ..... 345/103
6,069,603 A * 5/2000 Knapp ..... 345/91
6,252,571 B1 * 6/2001 Nomura et al. ..... 345/208
6,266,113 B1 * 7/2001 Yamazaki et al. ..... 349/115
6,320,562 B1 * 11/2001 Ueno et al. ..... 345/87

* cited by examiner

*Primary Examiner*—Bipin Shalwala
*Assistant Examiner*—Vincent E. Kovalick
(74) *Attorney, Agent, or Firm*—Sidley Austin Brown & Wood LLP

(57) ABSTRACT

A display device which has a liquid crystal display having a liquid crystal material, a driver for driving the liquid crystal display, and a controller for controlling the driver to drive at least a part of the liquid crystal display by selectively using one of a first drive method and a second drive method which are different from each other in operational principle of the liquid crystal material. The pulse voltage to drive at least one pixel of the liquid crystal display can be selectively set to any one of a plurality of kinds. The data pulse voltage applied to a data electrode can be selectively set to any one of a plurality of kinds to drive at least one pixel of the liquid crystal.

12 Claims, 24 Drawing Sheets

LIQUID CRYSTAL DISPLAY DEVICE AND DRIVING METHOD THEREOF

This application is based on application Nos. 10-326387 and 10-341918 filed in Japan, the content of which is hereby incorporated by reference.

BACKGROUND OF THE INVENTION

1. Field of the Invention

The present invention relates to a liquid crystal display device and a driving method thereof, and more particularly to a reflective liquid crystal display device with a memory effect and a driving method thereof.

2. Description of Prior Art

At present, information is widely distributed by use of printed matter; it, however, increases the volume of garbage and promotes exhaustion of forest resource for paper pulp. The present inventors think that these problems can be eased by developing a system of providing information being stored in digital information recording media so that users can get the information by use of display devices such as liquid crystal displays. Accordingly, they have developed an electronic book system using liquid crystal display devices. This system would be applicable to various kinds of information which has been distributed by printed matter, such as books (paperbacks, weekly magazines, monthly magazines, technical papers, etc.), newspapers and advertisements.

Publishers (makers) distribute digital information of books as recording media to users which have (own or rent) a display device of an electronic book system, and each user puts the recording media in the display device to get the information.

In order to attain such a system, the display device must be as small and thin as a book so that the user can use it anywhere. It is, therefore, required to reduce the size of the power source by using a liquid crystal display with a memory effect which consumes little electric power. Also, in order to lighten and thin the display device more, a reflective type which does not require a light source shall be used. In short, a reflective liquid crystal display with a memory effect shall be installed.

A reflective liquid crystal display with a memory effect, however, has a drawback that the response speed to a driving voltage is low. The achievement of the above-described system depends on how this drawback can be overcome. If the response speed can be improved, operation of turning the pages for skimming (operation in a rapid mode) will be possible, and the display device will be as easy to handle as a book and can be used as an electronic book.

Conventionally, low-molecular liquid crystal has been used for liquid crystal displays. In a type which uses glass substrates, when large substrates are used, it is difficult to take a rubbing alignment treatment on the substrates evenly, and consequently, the substrates are fragile. Also, the angle of field of the display area is narrow, and it is difficult to read information displayed thereon. Moreover, if a shock or pressure is applied to the display substrates, the alignment comes out of order, and reading of information becomes impossible. Further, the liquid crystal itself is volatile, and for a display of information, electric power must be supplied to the display device constantly and continuously, that is, the power consumption of the liquid crystal display is large.

SUMMARY OF THE INVENTION

An object of the present invention is to provide a liquid crystal display device which is small, thin and light to be portable, and does not require glass substrates for safety, makes an even display and consumes little electric power.

Another object of the present invention is to increase the response speed of liquid crystal to a driving voltage so as to provide a liquid crystal display which is capable of making a display in a rapid mode for skimming and to provide a driving method of the liquid crystal display.

The present invention suggests a liquid crystal display device which can be used as a portable electronic book and further suggests a vending system of electronic information.

In order to attain the objects, a display device according to the present invention comprises: a liquid crystal display having a liquid crystal material; a driver for driving the liquid crystal display; and a controller for controlling the driver to drive at least a part of the liquid crystal display by selectively using one of a first drive method and a second drive method which are different from each other in operational principle of the liquid crystal material.

More specifically, in the liquid crystal display device and a driving method thereof according to the present invention, the pulse voltage to drive at least one pixel of the liquid crystal display can be selectively set to any one of a plurality of kinds. The data pulse voltage applied to a data electrode can be selectively set to any one of a plurality of kinds to drive at least one pixel of the liquid crystal.

According to the present invention, a reflective liquid crystal display with a memory effect is used. It is preferred to use liquid crystal which exhibits a cholesteric phase in a room temperature (for example, chiral nematic liquid crystal) as the liquid crystal material. Such a liquid crystal with a memory effect does not require glass substrates, and there is no fear that the display will be fragile. With respect to such a liquid crystal display, the alignment control is easy, the angle of field is large, and a problem of unevenness does not arise even if the display is large. Moreover, because the liquid crystal has a memory effect, the display does not consume electric power to maintain a display, which means that the display is economic and is not influenced by noise, and the display can maintain a display even if electric power is cut off.

Especially by adopting a structure wherein liquid crystal which exhibits a cholesteric phase in a room temperature is filled between transparent plastic films, a liquid crystal display which is thin, light and strong against an external force (bend or shock) can be obtained, and this display is suited to be used as portable information equipment such as an electronic book, which is the aim of the present invention.

According to the present invention, the pulse voltage to drive at least one pixel of the liquid crystal display can be set to any one of a plurality of kinds. More specifically, the liquid crystal display is driven selectively in an ordinary mode wherein a pulse voltage is applied to all the pixels for a display of an image or in a rapid mode wherein at least one pixel is driven by a phase transition drive method. In the ordinary mode, all the pixels of the liquid crystal are reset to a focal-conic state, and thereafter, a pulse voltage is applied to the respective pixels. In the ordinary mode, an image is displayed completely; for the complete display, a duration for reset and a duration for application of a pulse voltage are necessary, and it takes a long time.

The phase transition drive is a known method, and by adopting this method, the time required for reset to a homeotropic state is shorter. In the phase transition drive method, only a display of a two-value image by on and off of a pulse voltage is possible. However, because this shortens the time to make a display, this method is used as a method for operation in a rapid mode to display a large volume of information (a plurality of images) for a short time as in a mode of turning the pages for skimming. As will be described in the following embodiments, a display in a mode of turning the pages is possible in various drive methods, and the use of the liquid crystal display as an electronic book becomes more convenient.

In the rapid mode, the data pulse voltage may be applied to each selected pixel a plurality of times for a display of the pixel. In this case, the pulse width is narrow, so that an image at a low contrast is displayed for a short time. As the number of pulses applied is increasing, the contrast of the displayed image becomes higher, and at last, a full-contrast image is displayed. For skimming, this drive can be performed in the order of page. In this method wherein the contrast of a displayed image becomes higher as the number of pulses applied is increasing, a fade-in display is possible, and by making a use of the fade-in effect, a display of intermediate tones is possible. Also, this drive can be so modified that the volume of information (for example, letters) displayed is increasing as the number of pulses applied is increasing and a complete image is displayed finally.

Further, by displaying new information so as not to overlap the information currently displayed, the time for erasing overlap portions and displaying new information thereon can be saved, and the time for switching images can be shortened. If a film type speaker is installed, a display device with an audio function can be obtained, and in the rapid mode, audio information compensates for lack of visual information.

BRIEF DESCRIPTION OF THE DRAWINGS

These and other objects and features of the present invention will be apparent from the following description with reference to the accompanying drawings, in which.

DETAILED DESCRIPTION OF THE PREFERRED EMBODIMENTS

Figure 1:
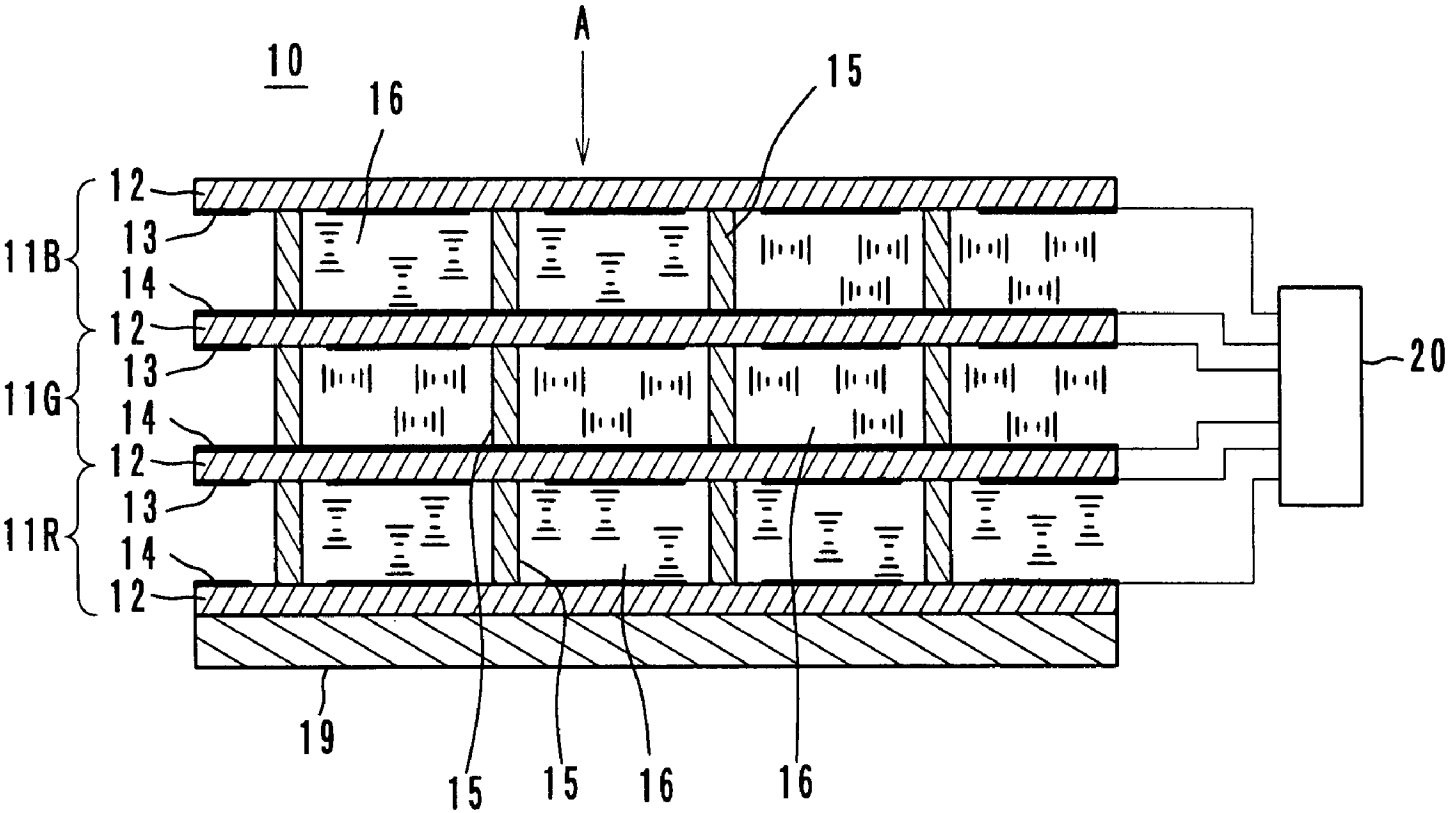
FIG. 1 is a sectional view of an exemplary liquid crystal display according to the present invention.

Embodiments of liquid crystal display devices and driving method thereof according to the present invention are described with reference to the accompanying drawings.

Display Device Using Liquid Crystal Which Exhibits a Cholesteric Phase

A liquid crystal display which has cholesteric liquid crystal or chiral nematic liquid crystal between two substrates makes a display by switching the liquid crystal between a planar state and a focal-conic state. In the planar state, the liquid crystal selectively reflects light of a wavelength $\lambda = P\ n$ (P: helical pitch of the cholesteric liquid crystal, n: average refractive index of the liquid crystal). In the focal-conic state, if the wavelength of light selectively reflected by the cholesteric liquid crystal is in the infrared spectrum, the liquid crystal scatters light, and if the wavelength of light selectively reflected is shorter than the infrared spectrum, the liquid crystal transmits visible light.

Therefore, by setting the wavelength of light selectively reflected by the liquid crystal within the visible spectrum and providing a light absorbing layer on the side of the display opposite the observing side, the liquid crystal, in the planar state, makes a display of a color corresponding to the wavelength of light selectively reflected and in the focal-conic state, makes a black display. Also, by setting the wavelength of light selectively reflected by the liquid crystal within the infrared spectrum and providing a light absorbing layer on the side of the display opposite the observing side, the liquid crystal, in the planar state, reflects infrared light and transmits visible light, thereby making a black display, and in the focal-conic state, scatters light, thereby making a white display.

If the threshold voltage to untwist liquid crystal which exhibits a cholesteric phase (first threshold voltage) is Vth1, by applying the voltage Vth1 to the liquid crystal for a sufficient time and thereafter dropping the voltage to less than a second threshold voltage Vth2 which is lower than the first threshold voltage Vth1, the liquid crystal comes to the planar state. By applying a voltage which is higher than Vth2 and lower than Vth1 for a sufficient time, the liquid crystal comes to the focal-conic state. Each of the states is maintained even after stoppage of application of the voltage. It has been found that such liquid crystal also comes to a state where these two states are mixed, which means that the liquid crystal can make a gray scale display (refer to U.S. Pat. No. 5,384,067).

Thus, liquid crystal which exhibits a cholesteric phase has a memory effect, which means that the liquid crystal can maintain its display after stoppage of application of a voltage. Therefore, by driving a plurality of pixels of the display by a simple matrix driving method, a display of a desired image or letters becomes possible. This kind of liquid crystal, however, has a hysteresis characteristic, and even when the same driving voltage is applied, the display changes depending upon the previous state of the liquid crystal.

In consideration for this characteristic, in an ordinary mode, first, all the pixels are reset to the focal-conic state, and thereafter, a selective signal is sent to the pixels to determine the state of each pixel. It takes a long time to change the liquid crystal into the focal-conic state; in this method, however, all the pixels are reset to the focal-conic state simultaneously, and only one time of resetting the liquid crystal to the focal-conic state is necessary while making one display. As a result, the speed of display renewal by the simple matrix driving method.

As will be described later, a liquid crystal display used for the present invention is a laminate of a resin film, transparent electrodes, an alignment controlling layer, a liquid crystal material, an alignment controlling layer, transparent electrodes and a resin film, and the combination of the alignment controlling layers and the liquid crystal material determines the alignment. Ordinarily, both the upper alignment controlling layer and the lower alignment controlling layer are subjected to the same alignment treatment; in accordance with the coloration, the driving method, the usage, etc., the upper alignment controlling layer and the lower alignment layer may be different.

With respect to the alignment controlling layers, the function of these layers are not necessarily what the name indicates. The function of these layers is rather to improve the stability of the liquid crystal molecules than to control the alignment of the liquid crystal molecules.

Structure of the Liquid Crystal Display

FIG. 1 shows an embodiment of a reflective liquid crystal display used for the present invention. This liquid crystal display 10 has, on a light absorber 19, a red display layer 11R which makes a display by switching between a red selective reflection state and a transparent state. On the red display layer 11R, a green display layer 11G which makes a display by switching between a green selective reflection state and a transparent state is provided, and on the layer 11G, a blue display layer 11B which makes a display by switching between a blue selective reflection state and a transparent state is provided.

Each of the display layers 11R, 11G and 11B has a resin columnar structure 15 and liquid crystal 16 between transparent substrates 12 which has transparent electrodes 13 and 14, respectively, thereon. On the transparent electrodes 13 and 14, an alignment controlling layer or an insulating layer may be provided.

The transparent electrodes 13 and 14 of each layer are connected to a driving circuit 20, and a specified pulse voltage is applied between the electrodes 13 and 14. In response to the voltage applied, the liquid crystal 16 switches between a transparent state wherein the liquid crystal 16 transmits visible light and a selective reflection state wherein the liquid crystal 16 selectively reflects visible light of a specified wavelength, thereby switching a display.

The transparent electrodes 13 and 14 of each display layer are in the form of strips arranged in parallel at uniform intervals. The electrode strips 13 face the electrode strips 14, and the extending direction of the electrode strips 13 and the extending direction of the electrode strips 14 are perpendicular to each other. Electric power is applied between the upper electrode strips and the lower electrode strips. Thereby, a voltage is applied to the liquid crystal 16 in a matrix, so that the liquid crystal makes a display. This is referred to as a matrix drive. By performing this matrix drive toward the display layers sequentially or simultaneously, the liquid crystal display 10 displays a full-color image.

Because the light absorber 19 is provided on the bottom with respect to the observing direction (indicated by arrow "A"), the light which has passed through the display layers 11R, 11G and 11B is wholly absorbed by the light absorber 19. When all the display layers 11R, 11G and 11B are in the transparent state, a black display is made. As the light absorber 19, for example, a black film can be used. It is also possible to coat black paint such as black ink on the bottom of the display 10 as the light absorber 19.

In FIG. 1, the red display layer 11R is in a planar state, the green display layer 11G is in a focal-conic state, and the blue display layer 11B is in a state wherein the planar state and the focal-conic state are mixed.

Materials for the Display

As the transparent substrates 12, transparent glass plates and transparent resin films can be used. As the transparent resin films, polyalylate resin, polyether sulfone resin, polycarbonate resin, norbornene resin, amorhous polyolefine resin, modified acrylate resin, etc. can be named. Such resin films used as the transparent substrates 12 are required to have the following characteristics: high light transmittance, optical non-anisotropy, dimensional stability, surface smoothness, antifriction, elasticity, high electric insulation, chemical resistance, liquid crystal resistance, heat resistance, moisture resistance, a gas barrier function, etc.

As the transparent electrodes 13 and 14, ITO, NESA coat, etc. are usable. Such a material is formed into a membrane on the transparent substrates 12 by a sputtering method, a vapor deposition method or the like. The lowermost electrodes 14 may be preferably black electrodes so as to also function as a light absorber.

Preferably, the liquid crystal 16 exhibits a cholesteric phase in a room temperature. Chiral nematic liquid crystal which is produced by adding a chiral agent to nematic liquid crystal can be used.

In nematic liquid crystal, stick-like polymeric liquid crystal molecules are arranged in parallel but do not form a layered structure. As nematic liquid crystal, biphenyl compounds, tolan compounds, pyrimidine compounds, cyclohexane compounds, etc. can be used by itself or by mixture. Preferably, such compounds with positive anisotropy of dielectric constant are used. Specific examples of nematic liquid crystal are K15 and M15 (made by Chisso Corporation) which mainly contain a cyano biphenyl compound, MN1000XX (made by Chisso Corporation) which is a mixture of liquid crystalline compounds, E44, ZLI-1565, TL-213 and BL-035 (made by Merck & Company).

A chiral agent is an additive which twists molecules of nematic liquid crystal. When a chiral agent is added to nematic liquid crystal, the liquid crystal molecules form a helical structure with uniform twist intervals, whereby the nematic liquid crystal exhibits a cholesteric phase.

By changing the content of the chiral agent in chiral nematic liquid crystal, the pitch of the helical structure can be changed. In this way, the wavelength of light to be selectively reflected by the liquid crystal can be controlled. Generally, the pitch of the helical structure is expressed by a term "helical pitch" which is defined as the distance between molecules which are located at 360° to each other along the helical structure of the liquid crystal molecules.

As the chiral agent, a compound wherein nematic liquid crystal molecules formed into a layered helical structure can be used. For example, nematic liquid crystal made of a biphenyl compound, a terphenyl compound, an ester compound or the like can be used. More specifically, chiral agents in the market S811, CB15, S1011 and CE2 (made by Merck & Company) which have an optically active group at an end can be used. Also, cholesteric liquid crystal with a cholesteric ring, which is typified by cholesteric nonanoate (CN), can be used as a chiral agent.

A plurality of chiral agents may be added to nematic liquid crystal by mixture. In this case, a mixture of chiral agents which have the same helical sense may be used or a mixture of chiral agents which have mutually different helical senses may be used. The use of a plurality of chiral agents changes the phase transition temperature of cholesteric liquid crystal and reduces a change in wavelength of light selectively reflected by the liquid crystal with a temperature change. Moreover, the use of a plurality of chiral agents changes the properties, such as anisotropy of dielectric constant, anisotropy of refractive index, viscosity, etc., of the cholesteric liquid crystal, thereby resulting in an improvement in display performance of the display.

The columnar structure 15 can be made of, for example, thermoplastic resin. Such thermoplastic resin used for the columnar structure 15 is required to be softened by heat and solidified by cool, not to chemically react to the liquid crystal material used and to have appropriate elasticity.

Specifically, polyvinyl chloride resin, polyvinilidene chloride resin, polyester methacrylate resin, polyacrylic ester resin, polyvinyl acetate resin, polystyrene resin, polyamide resin, polyethylene resin, polyptopylene resin, fluororesin, polyurethane resin, polyacrylonitrile resin, polyvinyl ether resin, polyvinyl ketone resin, polyvinyl pyrolidone resin, polycarbonate resin, chlorinated polyether resin, etc. can be used.

One or more of these materials may be used by itself or by mixture. Also, a mixture which at least contains one or more of these materials may be used.

Such a material is printed into a pattern of dotted columns by a conventional printing method. The size, the arrangement pitch, the shape (cylinder, drum, square pole, etc.) of the columns are determined depending on the size and the image resolution of the liquid crystal display. If the columns are arranged between the electrode strips 13, the actual display area will be large, which is preferable.

The columnar structure 15 may be composed of stripes as well as dotted columns. This shall be selected depending on the purpose. In order to regulate the gap between the substrates 12 more accurately, when the columnar structure 15 is formed, spacers which are smaller than the thickness of the resin membrane for the columnar structure 15, for example, glass fiber, glass balls, ceramic powder or spherical particles of an organic material are dispersed. Thereby, the gap hardly changes even with application of heat or pressure, and voltage unevenness and chromatic unevenness, etc. can be prevented.

Color Display

In the color display layers 11R, 11G and 11B using such chiral nematic liquid crystal, if the wavelength of light selectively reflected by the cholesteric liquid crystal is within the visible spectrum, in the focal-conic state wherein the helical axis of the cholesteric liquid crystal molecules is substantially parallel to the surfaces of the substrates, the liquid crystal becomes substantially transparent although scattering very little of visible light incident thereto. In the planar state wherein the helical axis of the cholesteric liquid crystal molecules is substantially perpendicular to the surfaces of the substrates, the liquid crystal selectively reflects light of a wavelength determined from the helical pitch. These two states of the liquid crystal can be switched by a change in field such as electric field, magnetic field, temperature, etc., and each of these states is maintained even after disappearance of such a field. In other words, the liquid crystal has a memory effect.

By controlling the amount of a chiral agent added to nematic liquid crystal, the helical pitch of the resultant chiral nematic liquid crystal can be regulated so that the chiral nematic liquid crystal will selectively reflect light of a wavelength, for example, corresponding to red light, green light or blue light. Thus, liquid crystal materials which selectively reflect light of red, green and blue, respectively, in the planar state and transmit visible light in the focal-conic state can be obtained. Then, by filling these liquid crystal materials among transparent electrodes, a color liquid crystal display can be obtained.

Addition of a Coloring Agent and Arrangement of a Color Filter for an Improvement in Color Purity and Contrast In the color display layers 11R, 11G and 11B, in order to improve the color purity of a display made by selective reflection and to absorb light components in the transparent state which lowers the transparency, a coloring agent may be added to each of the color display layers, or a color filter layer, that is, a color plate such as a color glass filter, a color film or the like may be provided to each of the color display layers. The coloring agent can be added to any one or more of the liquid crystal material, the resin material, the material of the transparent electrodes and the material of the transparent substrates which form each of the color display layers. However, in order not to degrade the display performance, a coloring agent or a color filter is added to or arranged in each of the color display layers so as not to interfere with the color display made by selective reflection.

Various well-known coloring agents can be added to the liquid crystal materials. Various dyes for resin and various dichroic dyes for liquid crystal displays are usable. As examples of dyes for resin, SPR-Red 1 and SPR-Yellow1 (made by Mitsui Toatsu Dyes, Ltd.) can be named. As examples of dichroic dyes for liquid crystal displays, SI-426, M-483 (made by Mitsui Toatsu Dyes Ltd.) can be named. A dye which does not interfere with the display by selective reflection and absorbs spectral light of a wavelength range which degrades the display performance shall be selected from these coloring agents and used for each color display layer. Since light components which degrade the display performance are mainly in a shorter wavelength range, it is preferred to use a coloring agent which absorbs light in a shorter wavelength range than the wavelength of light selectively reflected by the liquid crystal of the color display layer.

The amount of the coloring agent added is not specifically limited as long as it does not interfere with the switching operation for a display. However, a coloring agent is added preferably at least 0.1 wt % of the liquid crystal material, and 1 wt % is enough.

When providing a color filter instead of adding a coloring agent, the filter may be produced by adding a coloring agent to a transparent substance. Also, the filter may be originally colored or may be a membrane of a substance which functions as a coloring agent. Specifically, color glass filters in the market, wratten gelatin filter No. 8 and No. 9 (made by Eastman & Kodak Company), etc. are usable. Needless to say, it is possible to replace the transparent substrates 12 with substrates made of such a material for the filters so that the same effect can be obtained.

Method of Displaying Color

The liquid crystal display 10 which has color display layers 11R, 11G and 11B which are made of the above-described materials makes a red display by setting the liquid crystal 16 of the blue display layer 11B and the green display layer 11G to the focal-conic (transparent) state and setting the liquid crystal 16 of the red display layer to the planar (selective reflection) state. The liquid crystal display 10 makes a yellow display by setting the liquid crystal 16 of the blue display layer 11B to the focal-conic (transparent) state and setting the liquid crystal 16 of the green display layer 11G and the red display layer 11R to the planar (selective reflection) state. By setting the liquid crystal 16 of the respective color display layers to the transparent state or to the selective reflection state appropriately, displays of red, green, blue, white, cyan, magenta, yellow and black are possible. Also, by setting the liquid crystal 16 of the respective color display layers to the intermediate state, displays of intermediate colors are possible. Thus, the liquid crystal display 10 can be used as a full-color display.

The laminating order of the color display layers 11R, 11G and 11B in the liquid crystal display 10 is not limited to the order shown by FIG. 1, and other orders are possible. However, considering that light in a longer wavelength range is easier to be transmitted than light in a shorter wavelength, it is good to arrange the layer which selectively reflects light of a shorter wavelength in an upper position than the layer which selectively reflects light of a longer wavelength. With this arrangement, more light transmits downward, and a brighter display becomes possible. Accordingly, it is the best for good display performance to arrange the blue display layer 11B, the green display layer 11G and the red display layer 11R in this order viewing from the observing direction (indicated by arrow "A").

Exemplary Producing Method of the Liquid Crystal Display Device

Figure 2:
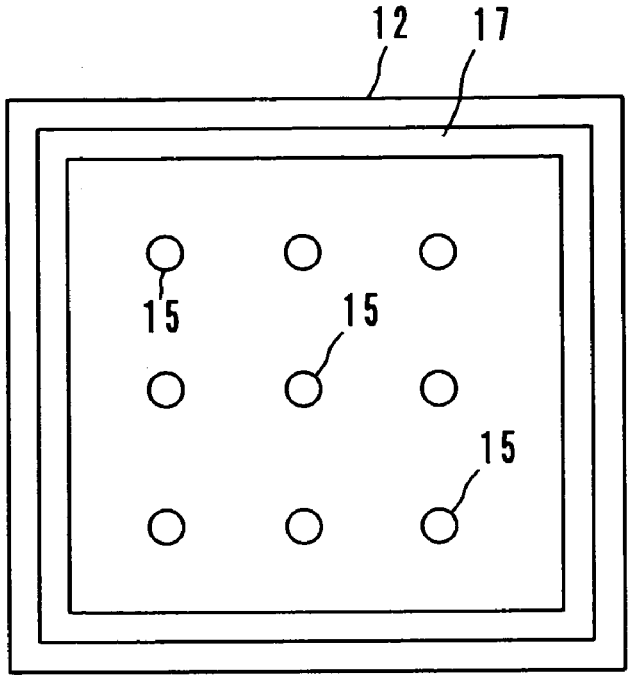
FIG. 2 is a plan view which shows a film substrate of the liquid crystal display with a columnar structure and a sealant formed thereon.

As an upper substrate 12, a PES film (polyeter sulfone made by Sumitomo Bakelite Co., Ltd.) with a thickness of 20 $\mu$m was used, and on the substrate 12, strips of ITO with a thickness of 700 Å were formed by a conventional sputtering method. Subsequently, a silicone oxide film with a thickness of 4000 Å was formed thereon as an insulating layer. Next, the resin columnar structure 15 was formed on the upper substrate 12 by the above-described printing method. FIG. 2 shows the upper substrate 12 with the columnar structure formed thereon. In this example, polyvinyl chloride was printed into a dotted pattern with a thickness of approximately 15 $\mu$m by use of a screen printing machine MS400 (made by Murakami Co., Ltd.).

Next, while the temperature was regulated to 25° C., thermoplastic polyester resin was printed on the substrate at the periphery as a sealant 17 by use of the screen printing machine MS400. Thereafter, the whole substrate was heated at 80° C. for twenty minutes on a hot plate, whereby the solvents contained in the columnar structure 15 and the sealant 17 were dried.

As a result, a columnar structure 15 composed of columns which have a diameter of 35 $\mu$m and a height of 10 $\mu$m and are arranged at a pitch of 300 $\mu$m, and a sealant 17 with a height of 10 $\mu$m were formed.

Next, SE-610 (made by Nissan Chemical Industries, Ltd.) was made into an alignment controlling layer with a thickness of approximately 500 Å by a conventional spin coat method, and this was heated at 180° C. for one hour.

Figure 3:
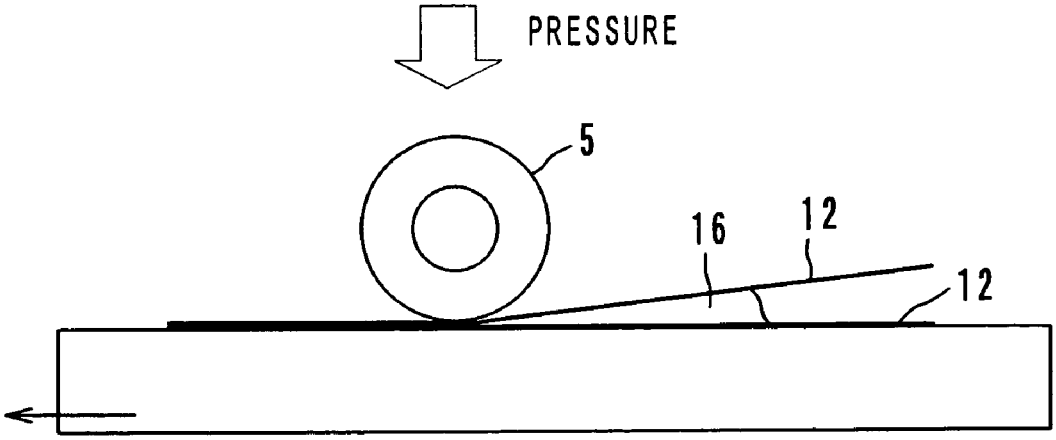
FIG. 3 is an illustration which shows a manufacturing process of the liquid crystal display.

Next, another PES film with electrodes and an insulating layer formed thereon (the same one as the upper substrate) was prepared as a lower substrate, and these two films were placed one upon another with the respective electrode surfaces facing each other. As FIG. 3 shows, liquid crystal 16 was dropped between the films 12 and sealed therein while being heated and pressed by a roller 5. At this stage, however, the end portion was kept unheated and unpressed to be open so that excess liquid crystal can be discharged through this open side.

This lamination of films was placed between stainless plates and was kept in a constant temperature bath at 160° C. for one hour while being loaded with 0.37 kg/cm$^2$. Thereby, the films 12 were joined together. Thereafter, the power of the constant temperature bath was turned off, and this was cooled to a room temperature while being kept loaded. Ultraviolet ray setting resin Photolek A-704-60 (made by Sekisui Finechemical Co., Ltd.) was coated on the periphery of the films 12, and the films 12 were exposed to ultraviolet rays, which secured the seal of the liquid crystal into the films 12.

As the liquid crystal, a chiral agent S-811 (made by Merck & Company) was added to nematic liquid crystal MLC6068-000 (made by Merck & Company) at 2.4 wt %. Cholesteric liquid crystal displays were produced in this way, and by using these liquid crystal displays, a full-color liquid crystal display was fabricated.

Driving Circuit and Driving method for the Liquid Crystal Display

Figure 4:
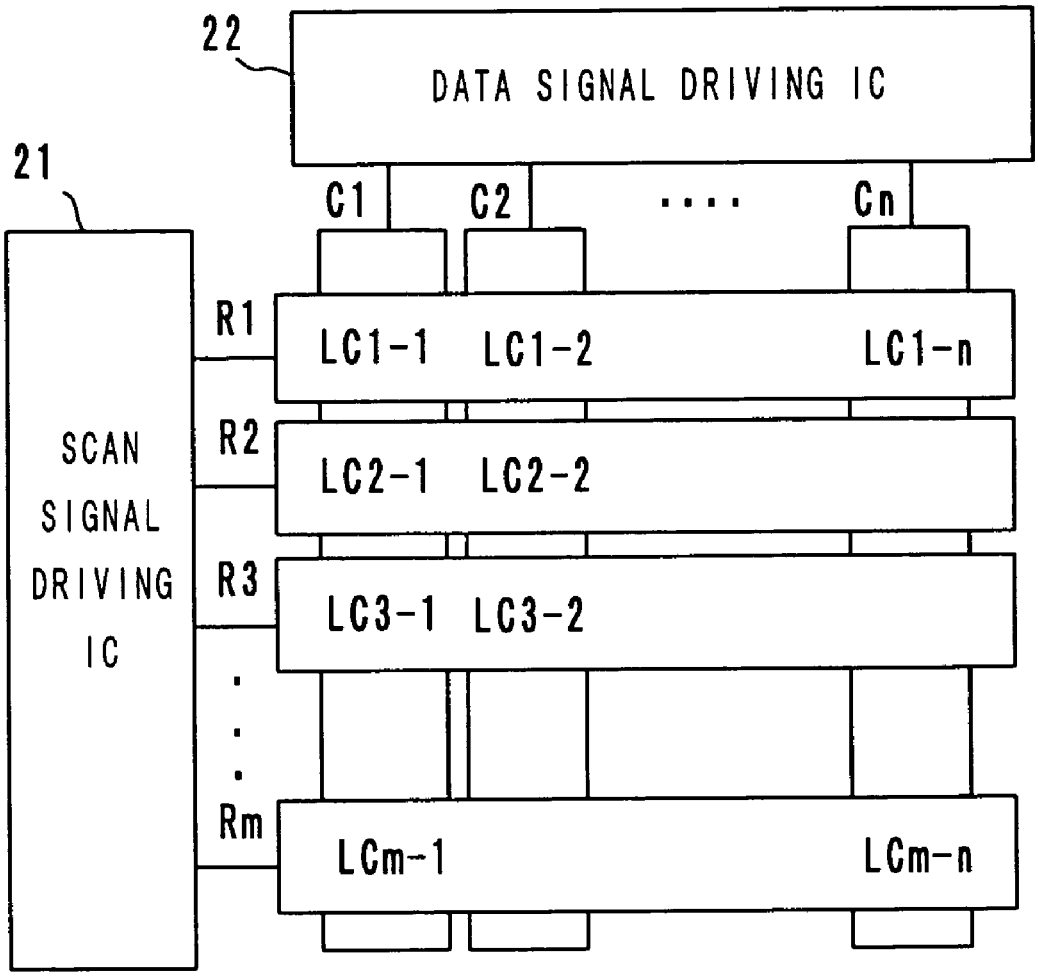
FIG. 4 is a block diagram which shows a matrix driving circuit for the liquid crystal display.

In each of the display layers of the liquid crystal display device 10, the pixels are structured in a simple matrix. Therefore, as FIG. 4 shows, the pixels can be expressed by a matrix of m×n, in which m is the number of scan electrodes (R1, R2 . . . Rm), and n is the number of data electrodes (C1, C2 . . . Cn). The pixel which is at the intersection of a scan electrode Ra and a data electrode Cb (a, b: natural numbers, a≦m, b≦n) is expressed by LCa-b. The scan electrodes and the data electrodes are connected to output terminals of a scan signal driving IC 21 and to output terminals of a data signal driving IC 22, respectively, and scan voltages and data voltages are applied to the respective electrodes from the driving ICs 21 and 22.

The driving circuit for the liquid crystal display 10 is not limited to such a matrix-structured driver. It is possible to carry out serial transmission of image data from the data signal driving IC 22 via a line latch memory for each line of the scan signal driving IC 21. In this case, the scan signal driving IC 21 does not have to cope with lines, and an IC for serial usage is sufficient. Thus, the cost for the driver can be reduced.

Figure 5:
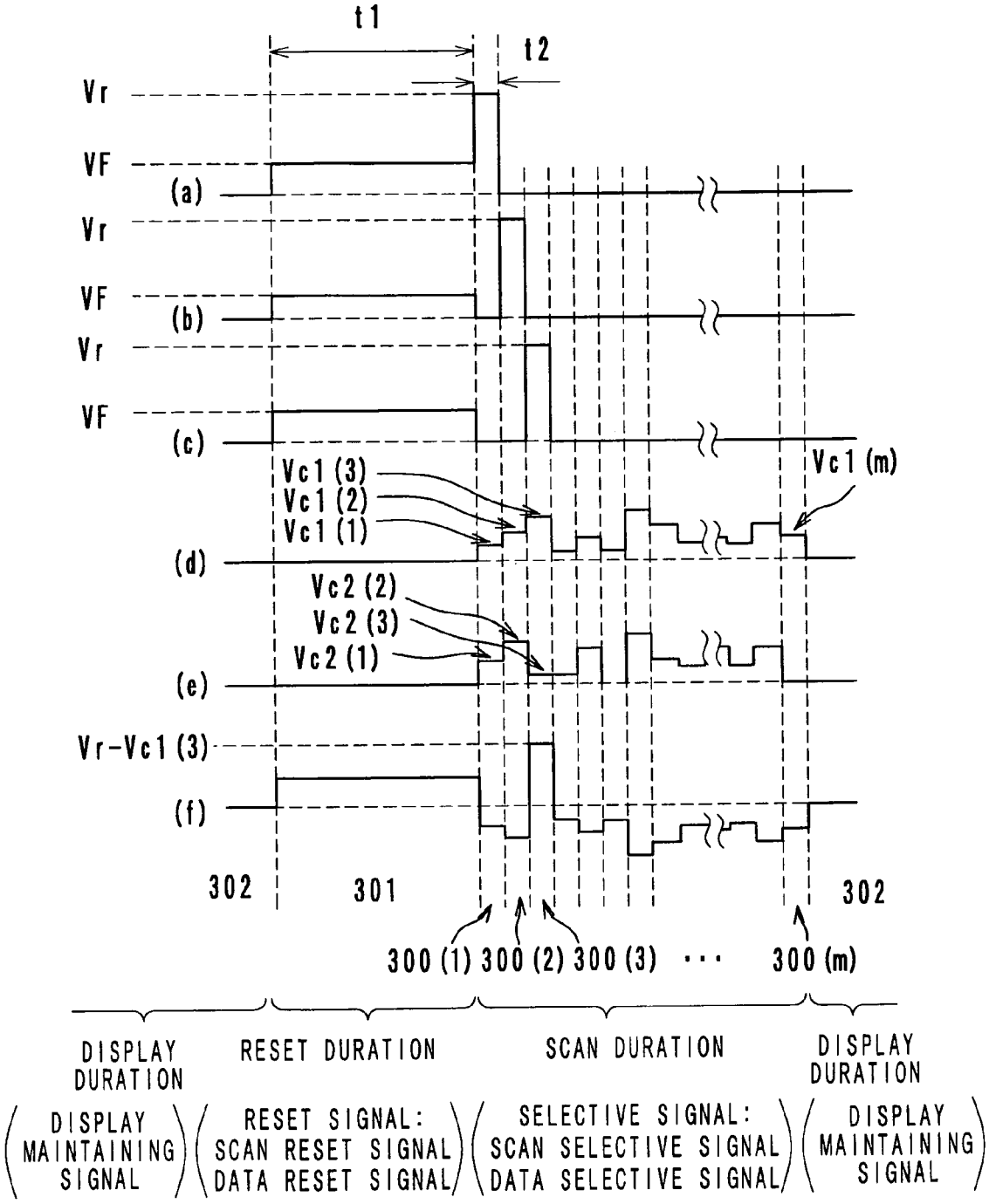
FIG. 5 is a chart which shows the waveforms of voltages applied in the matrix driving circuit.

This driving circuit is hereinafter described. FIG. 5 shows the waveforms of voltages applied to the scan electrodes and the data electrodes and the waveform of the resultant voltage applied to the liquid crystal. The waveforms (a), (b) and (c) show the voltages applied to the scan electrodes R1, R2 and R3, respectively. The waveforms (d) and (e) show the voltages applied to the data electrodes C1 and C2, respectively. The waveform (f) shows the voltage applied to the pixel LC3-1 at the intersection of the scan electrode R3 and the data electrode C1. This waveform (f) is divided into portions 300(1) through 300(1), 301 and 302. The portions 300(1) through 300(1) show a scan duration; the portion 301 is a reset duration; and the portion 302 is a display duration.

In the reset duration 301, a pulse voltage VF with a pulse width t1 is applied to each of the scan electrodes R1 through Rm. This pulse voltage is referred to as a scan reset signal. In the reset duration 301, no voltages are applied to the data electrodes C1 through Cn. A signal sent to the data electrodes in the reset duration is referred to as a data reset signal, and in this example, the voltage is 0. When the scan reset signal and the data reset signal are sent in the reset duration, a pulse voltage VF with a pulse width t1 is applied to the liquid crystal corresponding to all the pixels. This pulse voltage is referred to as a reset signal.

Next, in the period 300(3) of the scan duration, the part of the liquid crystal corresponding to the pixels on the scan electrode R3 are subjected to rewriting. The scan electrode R3 which is subjected to rewriting at this time is referred to as a selected scan electrode, and the other scan electrodes are referred to as non-selected scan electrodes. The period 300(3) is referred to as a selected scan period of the scan electrode R3. In the selected scan period of the scan electrode R3, a pulse voltage Vr with a pulse width t2 is applied to the scan electrode R3. This pulse voltage is referred to as a selective scan signal. Simultaneously, a pulse voltage Vc1(3) with a pulse width t2 is applied to the data electrode C1. This pulse voltage applied to the data electrode is referred to as a data signal. When the selective scan signal and the data signal are sent, a voltage Vr-Vc1(3) with a pulse width t2 is applied to the pixel LC3-1 at the intersection of the selected scan electrode R3 and the data electrode C1. This pulse signal is referred to as a selective signal.

In the periods 300(1), 300(2), 300(4) through **300(*m*) of the scan duration, the scan electrode R3 is designated as a non-selected scan electrode. These periods 300(1), 300(2), 300(4) through 300(*m*) are referred to as non-selected scan periods of the scan electrode R3. In the non-selected scan periods of the scan electrode R3, no voltages are applied to the scan electrode R3. Although the voltage is 0 in this example, this pulse voltage is referred to as a non-selective scan signal. In these periods 300(1), 300(2), 300(4) through 300(*m*), a data signal which indicates pulse voltages Vc1(1), Vc1(2), Vc1(4) through Vc1(*m*) in the respective periods, all of which have a pulse width t2, is sent to the data electrode C1. Accordingly, because of the non-selected scan signal and the data signal, in the periods 300(1), 300(2), 300(4) through 300(*m*), voltages −Vc1(1), −Vc1(2), −Vc1(4) through −Vc1(*m*) with a pulse width t2 are applied, respectively, to the pixel LC3-1 at the intersection of the scan electrode R3 and the data electrode C1**.

In the display duration 302, no voltages are applied to the scan electrodes R1 through Rm and the data electrodes C1 through Cn. This pulse voltage is referred to as a display maintaining signal.

Figure 6:
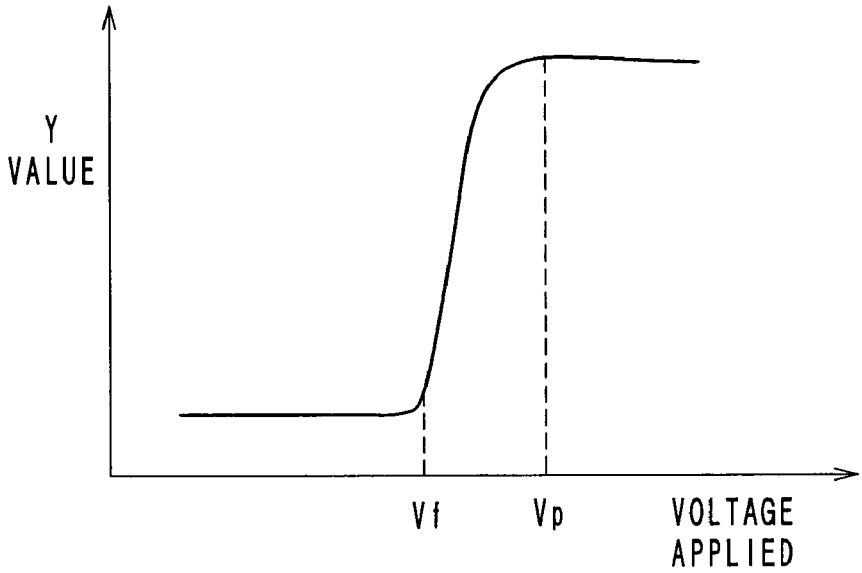
FIG. 6 is a graph which shows the relationship between the applied voltage in the matrix driving circuit and the Y value.

In the liquid crystal display 10, the display state of the liquid crystal is a function of the voltage applied and the pulse width. By resetting the whole liquid crystal to the focal-conic state wherein the liquid crystal shows the lowest Y value (luminous reflectance) and thereafter, applying a pulse voltage with a constant pulse width to the liquid crystal, the display state of the liquid crystal changes as FIG. 6 shows. In the graph of FIG. 6, the y-axis indicates the Y value, and the x-axis indicates the voltage applied. When a pulse voltage Vp is applied, the liquid crystal comes to the planar state wherein the liquid crystal shows the highest Y value, and when a pulse voltage Vf is applied, the liquid crystal comes to the focal-conic state wherein the liquid crystal shows the lowest Y value. Also, when an intermediate pulse voltage between Vp and Vf is applied, the liquid crystal comes to an intermediate state between the planar state and the focal-conic state wherein the liquid crystal shows an intermediate Y value, and thus, a display of an intermediate color is possible.

The voltage Vf is such a value to cause the liquid crystal to become to the focal-conic state by being applied for a relatively short time. The voltage VF is such a value to cause the liquid crystal to become the focal-conic state by being applied for a relatively long time. Generally, Vf is larger than VF.

Now, the functions of the signals are described.

In the reset duration 301, the reset signal is supplied to the whole liquid crystal corresponding to all the pixels so as to reset all the pixels to the focal-conic state. The voltage VF is a voltage to cause the cholesteric liquid crystal to become the focal-conic state. Preferably, the pulse width t1 of the reset signal is sufficiently long. If the voltage VF is applied for an insufficient time, the liquid crystal stays influenced by the previous state and cannot be reset to the focal-conic state evenly and entirely. The liquid crystal comes to the focal-conic state slowly by application of the voltage VF. Although the time for application of the voltage VF depends on the number of gray scales desired and the structure of the cell, the pulse width t1 may be set, for example, within a range from 100 milliseconds to one second.

In the scan duration, the selective signal and the non-selective signal are supplied to the liquid crystal. The following describes the voltages for the respective signals.

In the selected scan period of a scan electrode Ri (i is an integer from 1 to m), the scan electrode Ri is supplied with the selective scan signal of the voltage Vr=Vp with a pulse width t2, and a signal electrode Cj (j is an integer from 1 to n) is supplied with the data signal of a voltage Vcj(i) with the pulse width t2. In the non-selected scan periods of the scan electrode Ri, no voltages are applied to the scan electrode Ri. Thereby, in the selective scan period of the scan electrode Ri, a voltage Vr−Vcj(i)=Vp−Vcj(i) with the pulse width t2 is applied to the part of the liquid crystal corresponding to the pixel at the intersection of the scan electrode Ri and the signal electrode Cj. By setting the voltage Vcj(i) to a value within a range from 0 to Vp−Vf, the selective signal supplied to the liquid crystal can be set to any voltage within a range from Vp to Vf with the pulse width t2, and thus, any desired display is possible.

In the non-selected scan periods of the scan electrode Ri, the part of the liquid crystal corresponding to the pixels on the scan electrode Ri is supplied with the non-selective scan signal of a voltage from 0 to Vp−Vf. The liquid crystal to which the present invention is applied is non-volatile, and the display state does not change under a voltage less than a certain threshold voltage. Therefore, by setting the voltage of the non-selective scan signal to a value less than the threshold voltage, the display state of the liquid crystal can be maintained. In order to determine the display states of all the pixels, the above-described performance toward the scan electrode Ri is applied to all the scan electrodes R1 through Rm one by one.

In the display duration, no voltages are applied to the liquid crystal so as to maintain the display state. In other words, the voltage of the display maintaining signal is 0.

For renewal of the whole display, it takes the reset duration+the scan duration, that is, t1+m×t2. The time for making the liquid crystal to the focal-conic state is much longer than the time for making the liquid crystal to the planar state, that is, t1>>t2. In this method according to the present invention, even if the number of pixels is increased, the reset duration is the same, and high-speed display renewal is possible.

Figure 7:
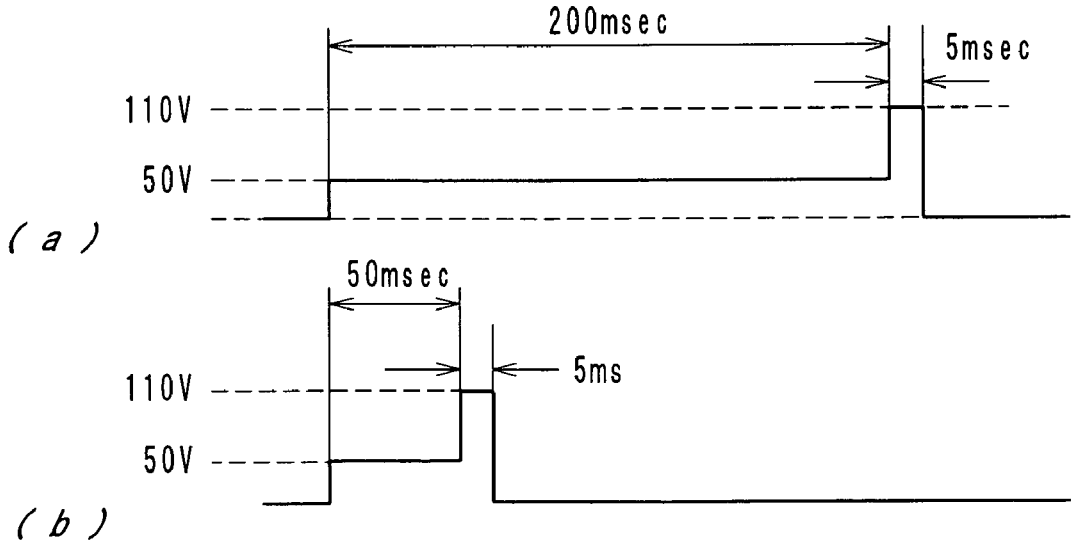
FIG. 7 is a chart which shows the waveforms of voltages which were experimentally applied to a test cell.

FIG. 7 shows waveforms (a) and (b) of pulse voltages applied to a test cell produced by the inventors as a trial. In the experiment, only one pixel was subjected. The voltage of the reset signal was 50V. The pulse width of the reset signal (the reset duration) was 200 msec in the case of (a) and 50 msec in the case of (b). As the selective signal to set the pixel to the planar state, 90V-Vc (110V) was applied for 5 msec. Although the voltage of the selective signal was set to 110V in the experiment, the signal may be of any other voltage. The voltage shall be determined depending on the material and the thickness of the liquid crystal and the pulse width of the signal.

In the case of waveform (a) wherein the reset signal was supplied for 200 msec, whether the pixel was previously in the planar state or in the focal-conic state, the pixel came to the planar state in good condition by application of the selective signal, and displays of gray scales were possible by changing the voltage of the selective signal. On the other hand, in the case of waveform (b) wherein the reset signal was supplied for 50 msec, the reset of the pixel was not always sufficient, and when the pixel was set to the planar state thereafter, the Y value varied.

As is apparent from this experiment, as the reset signal application time is set longer, the influence of the previous state of the liquid crystal becomes weaker. In other words, by setting the reset signal application time to be sufficiently long, display renewal can be well done without being influenced by the previous state. In the case of waveform (a), the reset signal application time was 200 msec, and a display with four tones was possible. If the reset signal is supplied for more time, variations in display state caused by the influence of the previous state will be reduced, and a display with more tones will be possible.

Rapid Mode by Phase Transition Drive

Figure 8:
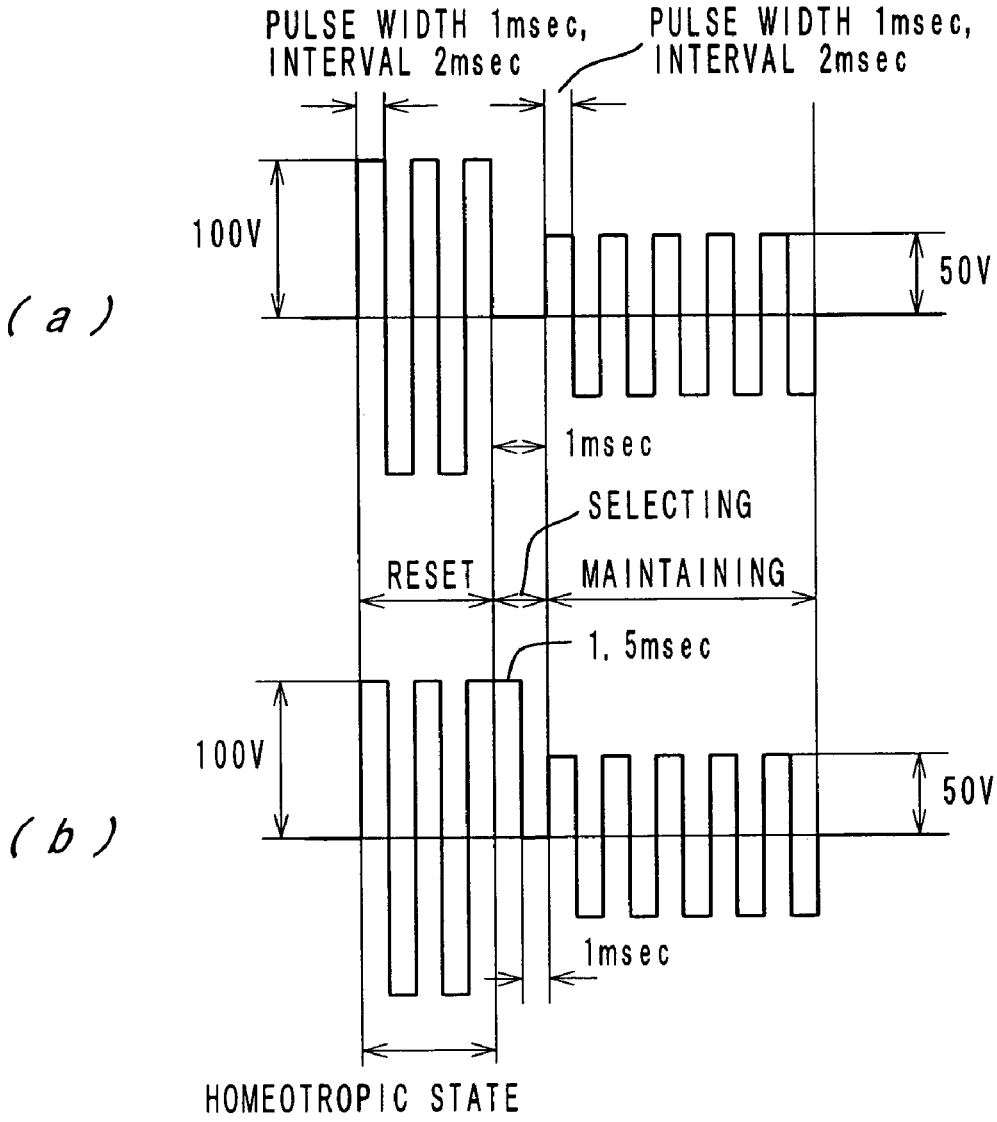
FIG. 8 is a chart which shows the waveforms of voltages applied for operation in a rapid mode.

FIG. 8 shows waveforms (a) and (b) of pulse voltages to drive the liquid crystal display 10 in the rapid mode. Operation in the rapid mode is divided into a reset duration (first duration), a selecting duration (second duration) and a maintaining duration (third duration).

In the case of waveform (a), first, a pulse voltage of 100V is applied to the liquid crystal to cause the liquid crystal to come to a homeotropic state, and in the selecting duration, no voltages are applied. Then, in the maintaining duration, a pulse voltage of 50V is applied. In this case, the liquid crystal comes to the focal-conic state and maintains the state, that is, scatters light incident thereto (off state). In the case of waveform (b), the liquid crystal is reset to the homeotropic state, and subsequently, a pulse voltage of 100V is applied for 1.5 msec. Then, in the maintaining duration, a pulse voltage of 50V is applied. In this case, the liquid crystal changes to the planar state and maintains the state, that is, transmits light incident thereto (on state). By selecting the waveform (a) or (b) in accordance with image data, a two-value (on and off) image can be displayed.

First Exemplary Drive in Ordinary Mode

Figure 9:
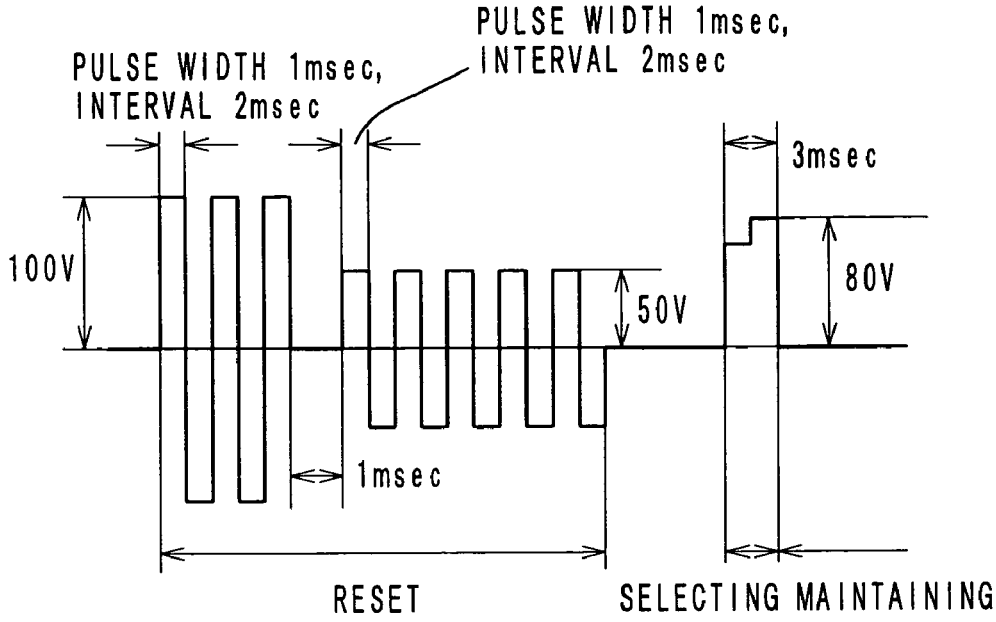
FIG. 9 is a chart which shows a first exemplary waveform of a voltage applied for operation in an ordinary mode.

FIG. 9 shows a pulse voltage of a first exemplary waveform which drives the liquid crystal display 10 to make a multi-tone display in the ordinary mode. In this first example, in the reset duration (first duration), the liquid crystal is reset to the focal-conic state, and in the selecting duration (second duration), a pulse voltage which changes between two stages is applied for three milliseconds to reproduce a multi-tone image. In the maintaining duration (third duration), a voltage of 0V is applied.

Figure 10:
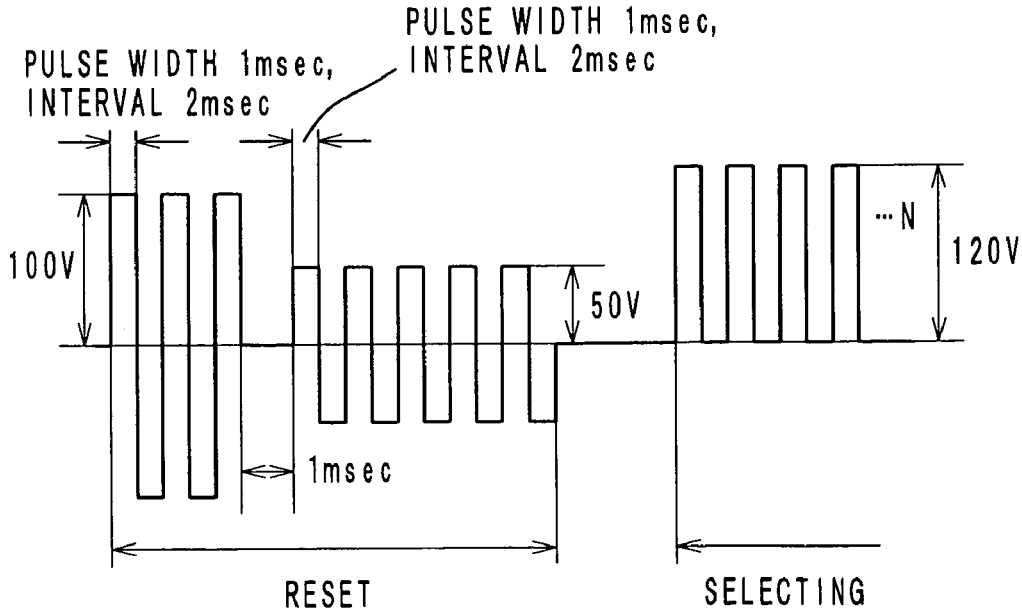
FIG. 10 is a chart which shows a second exemplary waveform of a voltage applied for operation in the ordinary mode.
Figure 11:
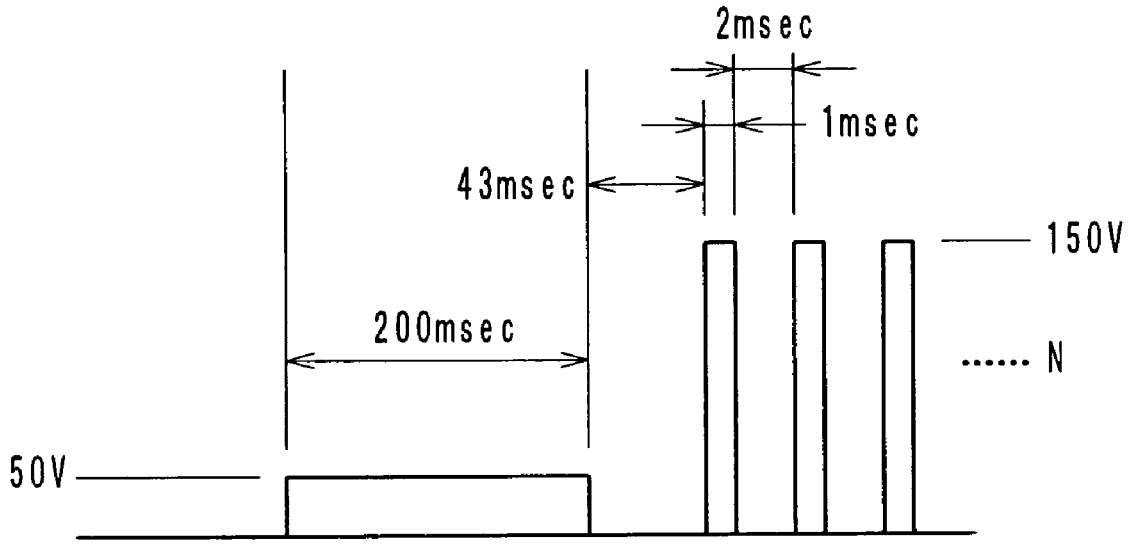
FIG. 11 is a chart which shows a third exemplary waveform of a voltage applied for operation in the ordinary mode.

In the drive in the rapid mode shown by FIG. 8 and in the drives in the ordinary mode shown by FIGS. 9, 10 and 11, a pulse waveform generated by a pulse generator is amplified to a necessary voltage by an amplifier, and this pulse voltage is applied to a driver terminal of the liquid crystal display 10 by a multiplexer provided with a multi-terminal type voltage switching device.

Second Exemplary Drive in Ordinary Mode

FIG. 10 shows a pulse voltage of a second exemplary waveform which drives the liquid crystal display 10 to make a multi-tone display in the ordinary mode. In the reset duration, the same process as in the first example shown by FIG. 9 is performed, and in the selecting duration, a pulse voltage of 120V is applied to each pixel for one millisecond N times at intervals of one millisecond. The number of times N is arbitrary. As the number of pulses applied is increasing, the contrast of a displayed image becomes higher, and for example, after the fourth application of the pulse voltage, a complete image with full contrast is displayed. In such a case, a fade-in display is possible. If in the middle of fade-in of an image, a command for a display of the next page is inputted, the switching of display will be the same as in the rapid mode.

Third Exemplary Drive in Ordinary Mode

FIG. 11 shows a pulse voltage which is applied to the electrodes 13 and 14 of the liquid crystal display 10 for a drive in the ordinary mode. After application of the reset signal of 50V for 200 milliseconds, a selective signal of 150V is applied to each pixel for one millisecond N times. The number N is arbitrary. If N=2, it takes only a short time for a display of an image although the contrast is low. If images are displayed in the order of page in this drive method, the display will be the same as in the rapid mode. On the other hand, if N=4, as the number of pulses applied is increasing, the contrast of a displayed image becomes higher, and a complete image with full contrast is displayed after the fourth application of the pulse voltage. In this case, a fade-in display is possible. If in the middle of fade-in of an image, a command for a display of the next page is inputted, the switching of display will be the same as in the rapid mode.

Figure 12:
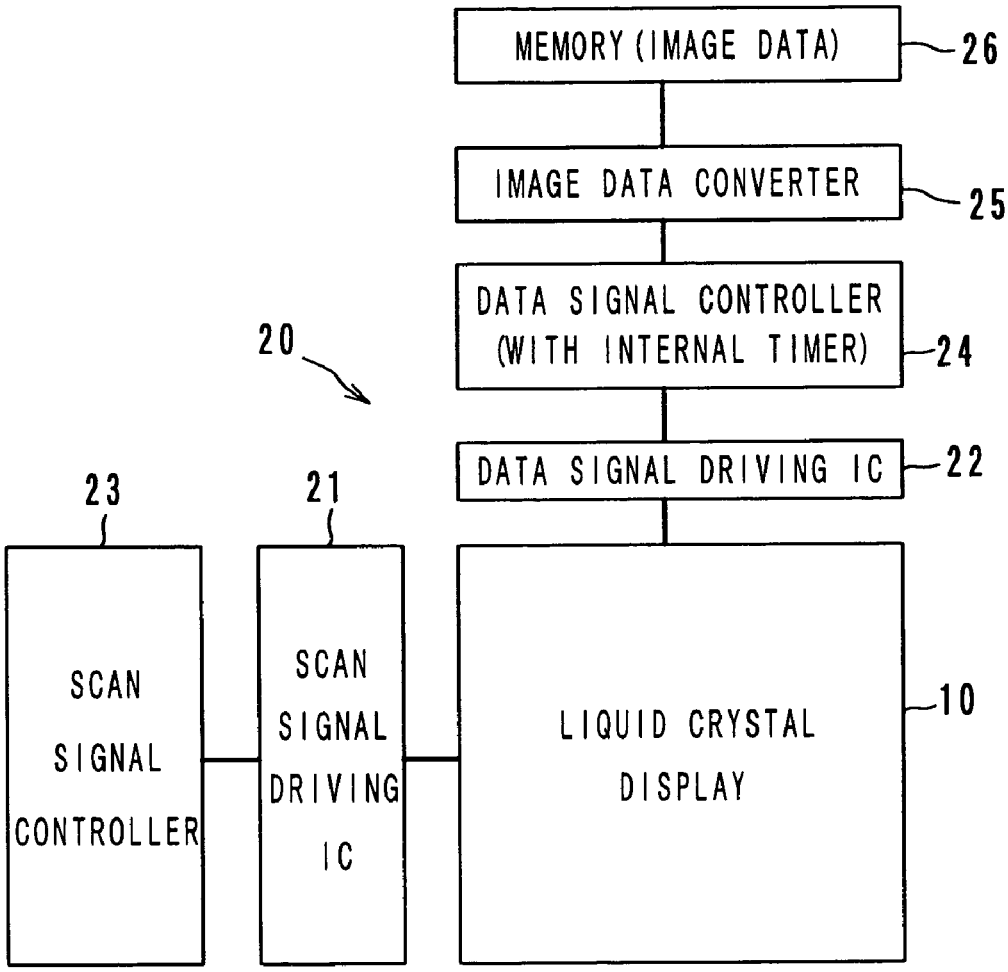
FIG. 12 is a block diagram which shows a driving/image signal processing circuit used in an embodiment of the present invention.

FIG. 12 shows a driving/image data processing circuit 20 in which image data is rewritable. To the liquid crystal display 10, the scan signal driving IC 21 and the data signal driving IC 22 are connected, and these ICs 21 and 22 are driven in accordance with a control signal sent from a scan signal controller 23 and a control signal sent from a data signal controller 24 with an internal timer. In a memory 26, data of a plurality of images are stored, and data of an image to be newly displayed are inputted from a memory 26 to the signal controller 24 after being converted into a selective signal by an image data converter 25.

The internal timer times the renewal of an image on the liquid crystal display 10 in the rapid mode. The memory 26 is stored with image data of a plurality of pages and outputs the image data in order of page based on the count of the timer. The image data stored in the memory 26 are transmitted from a CPU 33 which will be described later.

Figure 13:
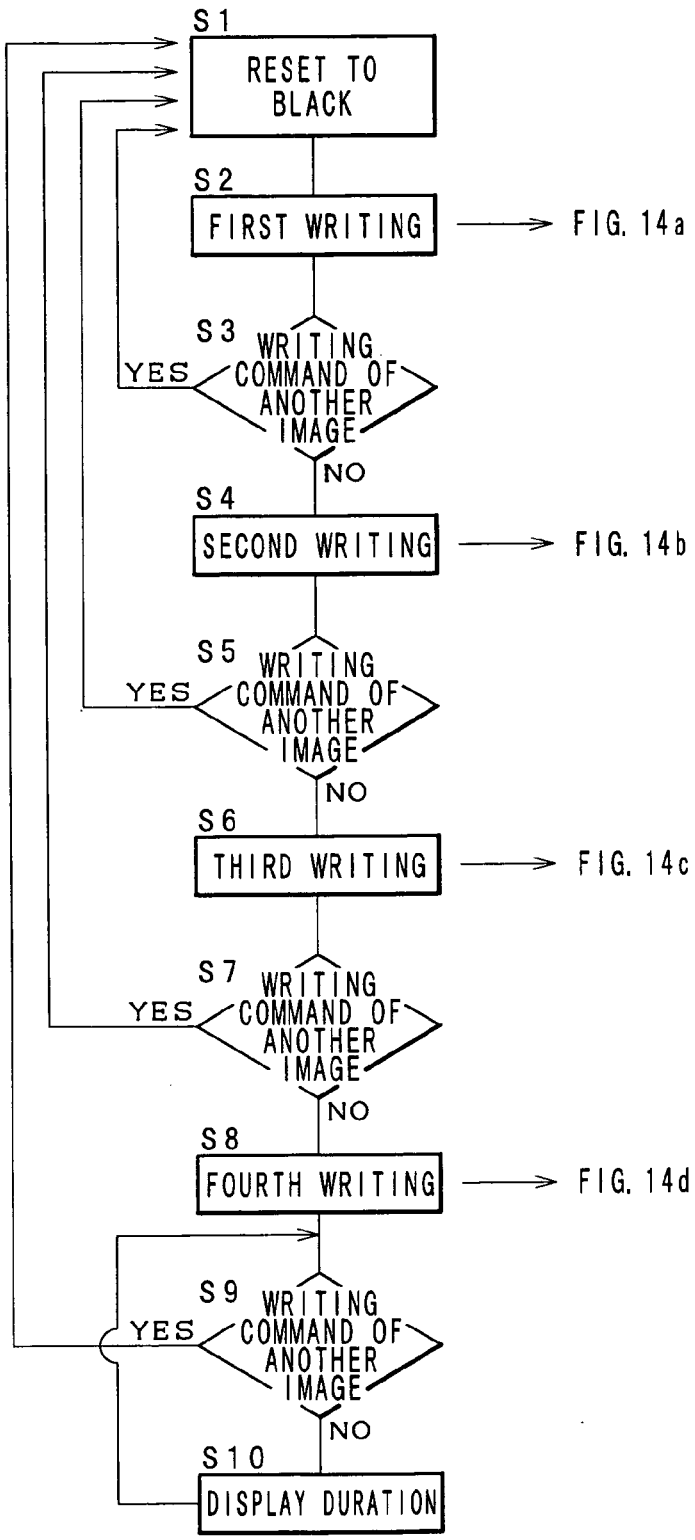
FIG. 13 is a flowchart which shows a control procedure for operation in the ordinary mode.

FIG. 13 shows a control procedure for a fade-in display of a multi-tone color image adopting the second exemplary drive in the ordinary mode shown in FIG. 10. In this control procedure, a pulse voltage is applied four times. The contrast becomes higher after every application of the voltage, and after the fourth application, a complete color image is displayed. If a command for a display of another image is inputted in the middle of four applications of the pulse voltage, the display will change to the new image, and this is seen as operation in the rapid mode.

Figure 14A:
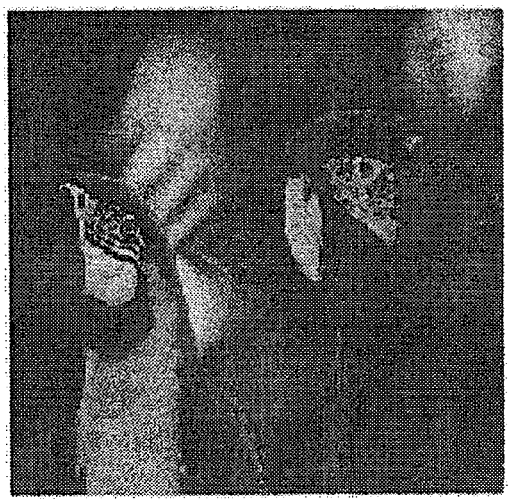
FIGS. 14*a* through 14*d* show images written by a first writing process, by a second writing process, by a third writing process and by a fourth writing process, respectively, in the control procedure shown by FIG. 13.
Figure 14B:
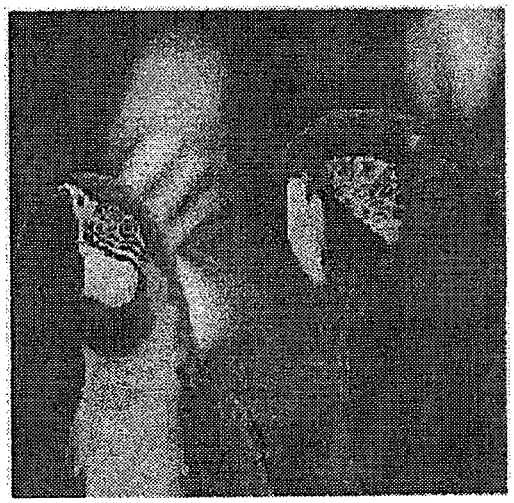
Figure 14C:
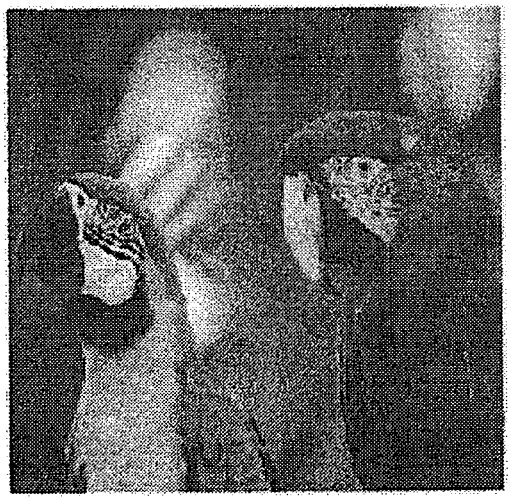
Figure 14D:
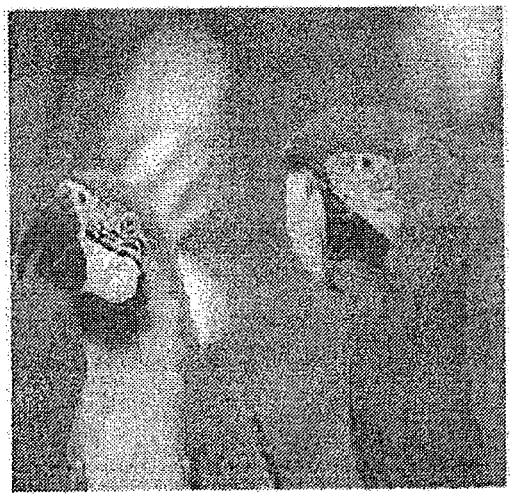

First, at step S1, the liquid crystal display 10 is reset. Next, at step S2, a first writing process is performed, whereby an image of ¼ contrast as shown by FIG. 14*a* is displayed. Subsequently, at steps S4, S6 and S8, a second writing process, a third writing process and a fourth writing process are performed, respectively, and the contrast of the displayed image becomes higher as shown by FIGS. 4*b*, 4*c* and 4*d*.

On the other hand, a command for a display of another image is inputted in the middle of any of the writing processes (see steps S3, S5, S7 and S9), the program goes back to step S1 to perform the reset process for a display of the next page. The input of the command for a display of another image is carried out by a turn-on of a rapid mode key (not shown).

Figure 15:
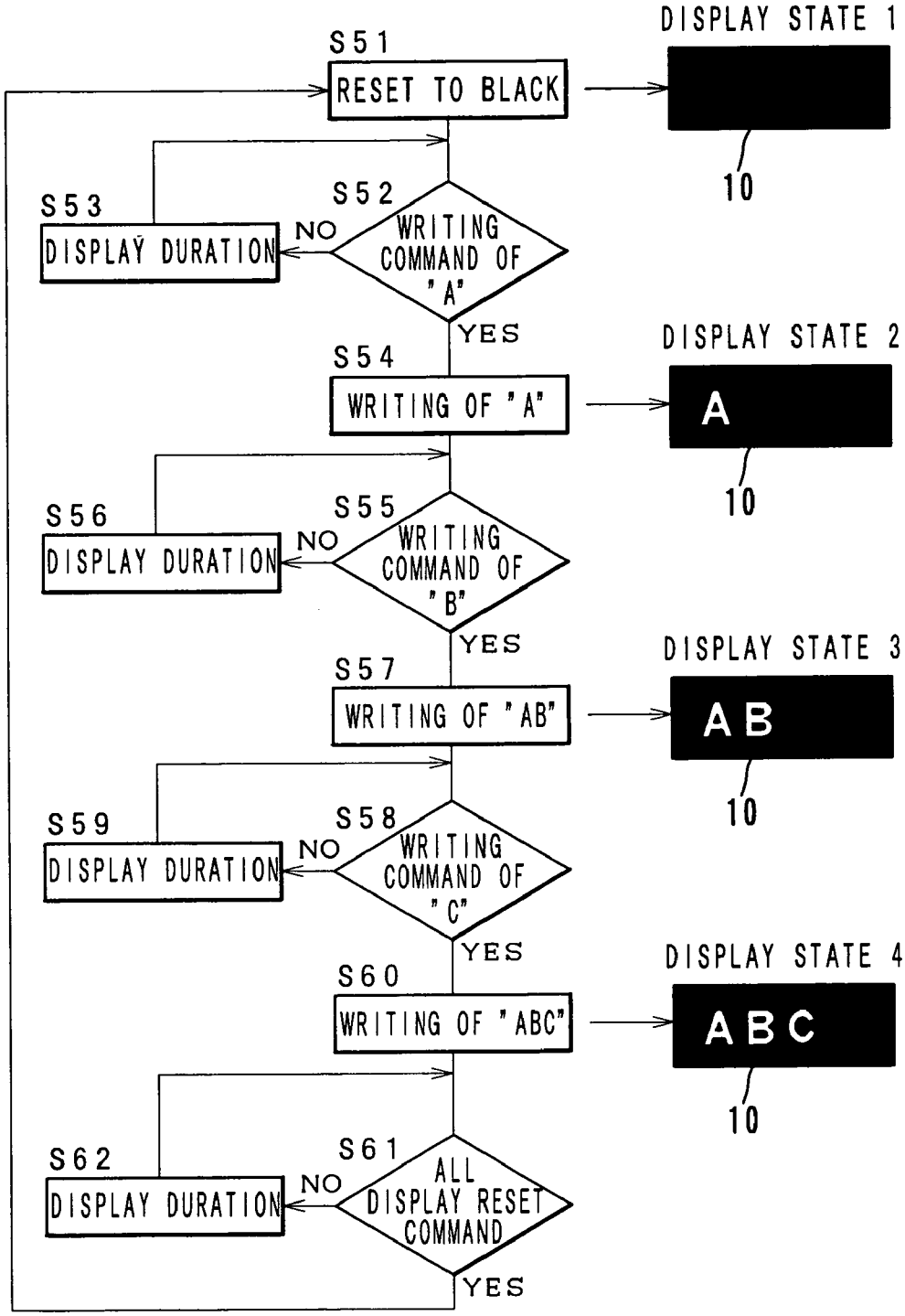
FIG. 15 is a flowchart which shows another control procedure of the liquid crystal display.

FIG. 15 shows another control procedure for a drive of the liquid crystal display 10. In this control procedure, a time for a display is divided into a reset duration (first duration), a scan duration (second duration) and a display duration (third duration) as shown by FIG. 5, and after the reset duration, the scan duration and the display duration are repeated a plurality of times. Then, when a specified image is displayed or when the observer inputs a reset command, the image is reset. Image data used in this procedure are two-value data.

First, at step S51, the liquid crystal display 10 is reset. Thereby, the display becomes black as shown by display state 1. When a writing command of a letter "A" is recognized at step S52, a letter "A" is written at step S54 (see display state 2). When a writing command of a letter "B" is recognized at step S55, writing of letters "A" and "B" is performed at step S57 (see display state 3). When a writing command of a letter "C" is recognized at step S58, writing of letters "A", "B" and "C" is performed at step S60 (see display state 4). Further, if there is still any letter to be displayed, a writing command is issued. Thus, after one reset process, desired letters are displayed on the liquid crystal display 10. In this case, newly added image data are combined with image data of the letters already displayed in such a way that the images (letters) will not overlap, and in accordance with the combined data, the liquid crystal display 10, and more specifically the scan electrodes 13 and the data electrodes 14 are driven.

When a reset command of all the display is recognized at step S61, the program goes back to step S51, and the reset process is performed. This all display reset command is issued when the writing process has been repeated a specified times, whereby a specified image (letters) have been displayed on the liquid crystal display 10 or when the observer inputs a reset command.

In this control procedure, the display states 1, 2, 3 and 4 are maintained until a writing command or a reset command is issued (see steps S53, S56, S59 and S62). The display at step S62 is maintained until an all display reset command is issued. When a reset command is recognized at step S61, letters on the next page are displayed on the liquid crystal display 10.

Figure 16:
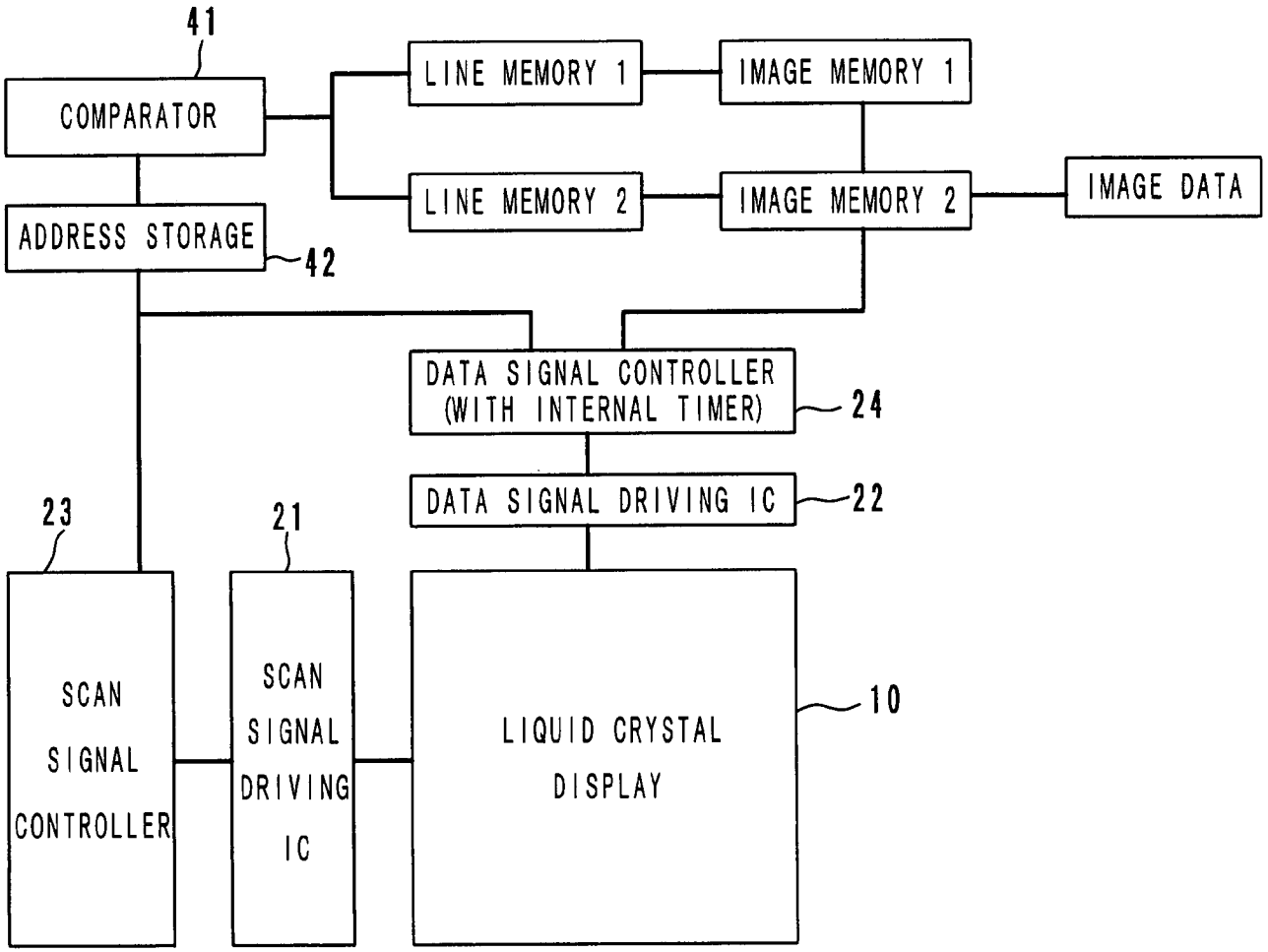
FIG. 16 is a block diagram which shows another exemplary driving circuit for the liquid crystal display.

FIG. 16 shows a circuit for rewriting only the part of an image which contains different data when displaying a new image. Because the liquid crystal display 10 has a memory effect, partial rewriting on this display 10 is possible.

First, image data of the currently displayed image is stored in an image memory 1. Image data of an image to be newly displayed is stored in an image memory 2. Data for one line (one scan electrode) are read from the image memory 1 and are stored in a line memory 1. In the same way, data for one line (one scan electrode) are read from the image memory 2 and are stored in a line memory 2. The data in the line memory 1 and the data in the line memory 2 are compared with each other by a comparator 41, and the numbers of lines which contain non-correspondent data are stored in an address storage 42. In this way, the parts (the lines corresponding to the scan electrodes) which contain different data from the data of the currently displayed image are selected, and only these parts are subjected to rewriting.

The controller 24 has an internal timer, and a predetermined time is set in the timer. When the time has passed, the scan signal controller 23 and the data signal controller 24, while referring to the addresses stored in the address storage 42, send control signals to the scan signal driving IC 21 and the data signal driving IC 22 for rewriting of only the parts. Thereby, the scan signal driving IC 21 and the data signal driving IC 22 drive only the parts of the liquid crystal to be rewritten. In this driving method, rewriting of only the parts to be rewritten is possible, and this is more speedy than rewriting of the entire display.

Information Display Device

Figure 17:
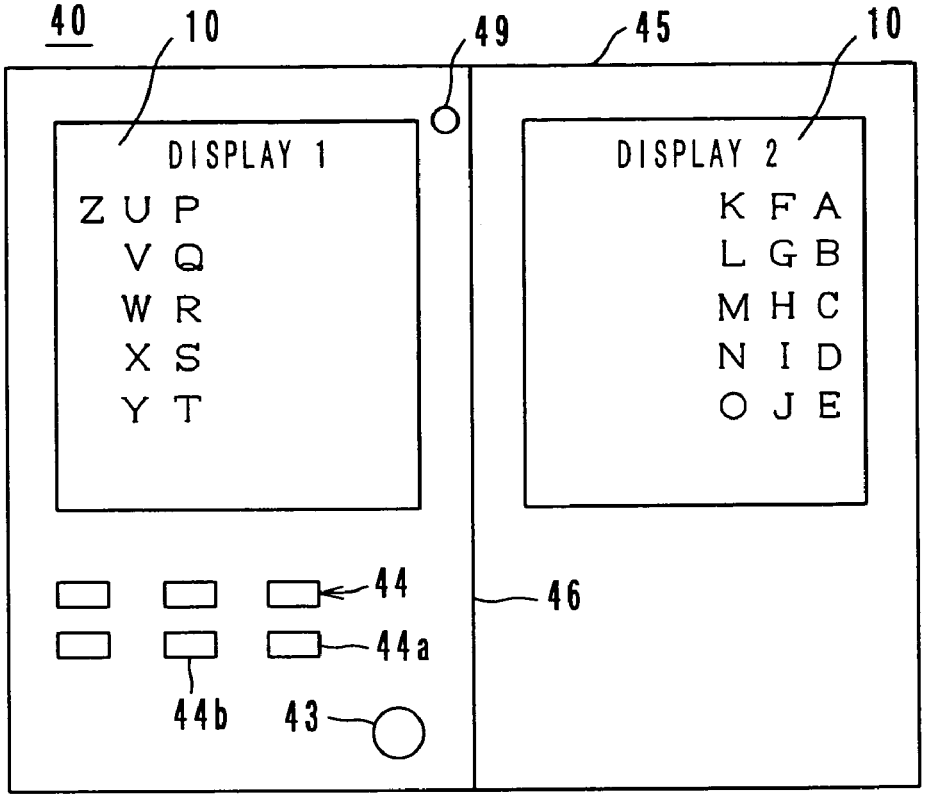
FIG. 17 is a plan view of an exemplary electronic book type information display device, showing an exemplary display in the rapid mode.

FIG. 17 shows a portable electronic book type information display device 40 wherein liquid crystal displays 10 are provided in right and left on a foldable cover 45. Here, the left-side display 10 is called display 1, and the right-side display 10 is called display 2. In this information display device 40, when Japanese sentences vertically written are displayed, the display 2 is used for odd pages, and the display 1 is used for even pages. In the rapid mode, on the display 2, image scanning is performed line by line from right to left, and on the display 1, image scanning is performed line by line from left to right.

Figure 18:
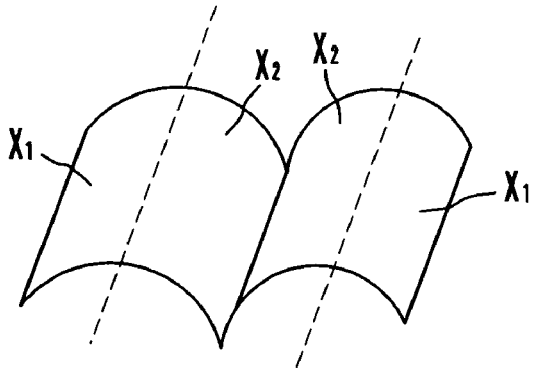
FIG. 18 is a perspective view of an open book.

As FIG. 18 shows, when paging through a book, a person is less likely to see information in the center portion $X_2$ and is more likely to see information in the side portions $X_1$. In the rapid mode, therefore, only information in the side portions $X_1$ is displayed to shorten the scan time, and images are switched subsequently page by page. By decreasing the number of lines displayed, the display speed is increased. The observer can change from the rapid mode to the ordinary mode when catching a desired page, whereby the page is fully displayed.

In FIG. 17, the number 43 denotes a power switch, and the number 44 denotes operation keys. In the operation keys 44, the key 44*a* is a rapid mode key. When the key 44*a* is pressed, the rapid mode is carried out, and when the key 44*a* is pressed again, the mode is returned to the ordinary mode. The key 44*b* is a page turn key used in the ordinary mode. When the key 44*b* is pressed, the displays 1 and 2 display next pages.

Figure 19:
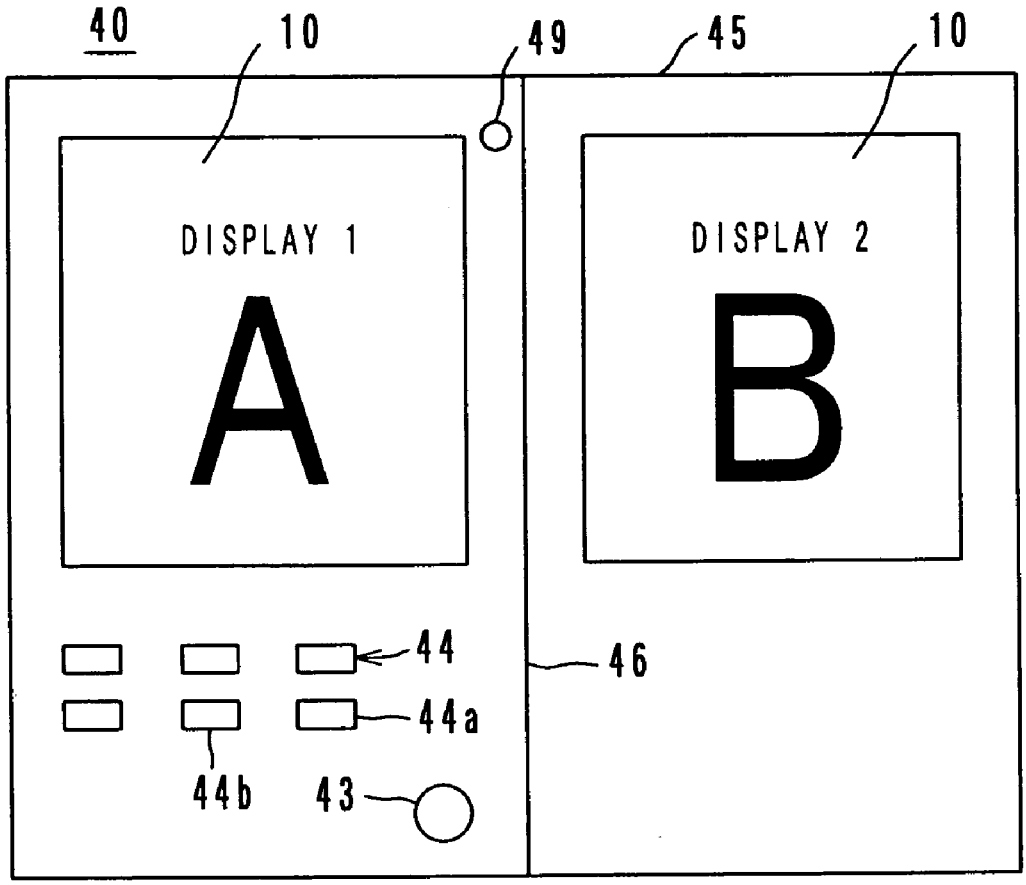
FIG. 19 is a plan view of the electronic book type information display device, showing another exemplary display in the rapid mode.

FIG. 19 shows an example of carrying out the rapid mode of the electronic book type information display device 40 in another method. In the rapid mode in this method, images are subsequently displayed on the displays 1 and 2 page by page. For example, when displaying images "A", "B" and "C", the images "A" and "B" are subsequently displayed on the displays 1 and 2, respectively, and while the image "B" is being scanned, scanning of the image "C" on the display 1 is started. In this method, images of odd pages and even pages are separately scanned on the displays 1 and 2 one after another, and thereby, the display time is shortened. By using these two displays effectively, the display time can be shortened to a half of the display time which is required when only one display is used.

Figure 20:
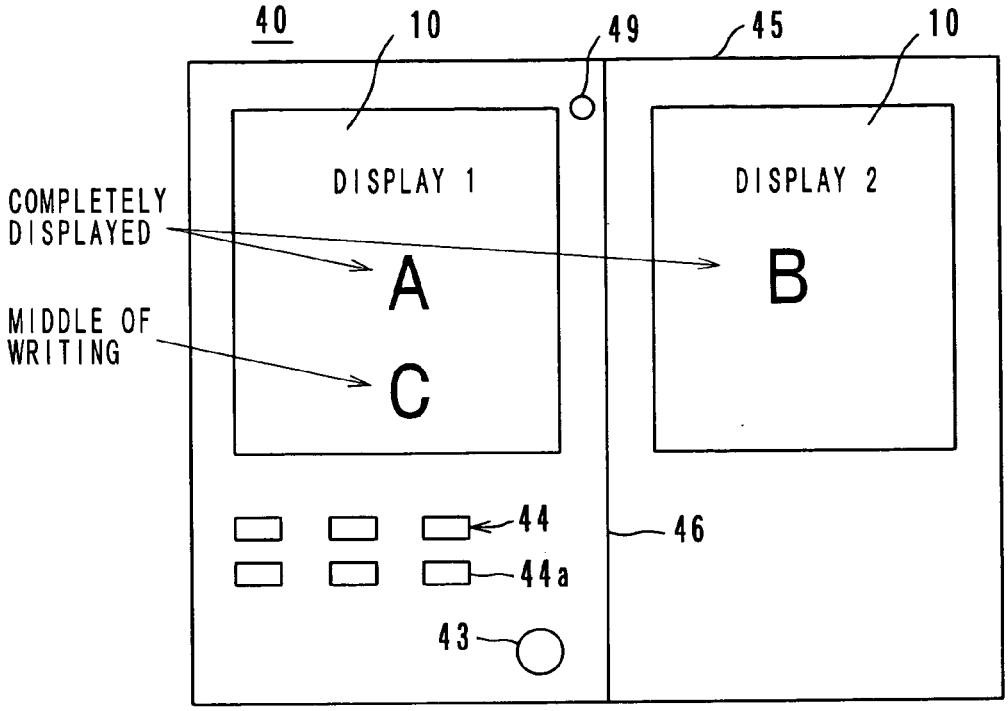
FIG. 20 is a plan view of the electronic book type information display device, showing another exemplary display in the rapid mode.

Further, in the subsequent display on the displays 1 and 2 in the rapid mode, if the following method is adopted, the rapid mode can be carried out at a higher speed. As FIG. 20 shows, each of the displays 1 and 2 is divided into an upper section and a lower section. First, the upper sections of the displays 1 and 2 are reset, and images A and B are displayed thereon by the driving method shown by FIG. 11. Before each of the images are completely displayed at full contrast, writing of an image C on the lower section of the display 1 is started by the driving method shown by FIG. 11. Subsequently, writing of the next image on the lower section of the display 2 is started in the same way. When the image A has been completely displayed, the image A is erased, and writing of the next image is started in the section. Thus, the rapid mode can be carried out more speedily.

Figure 21:
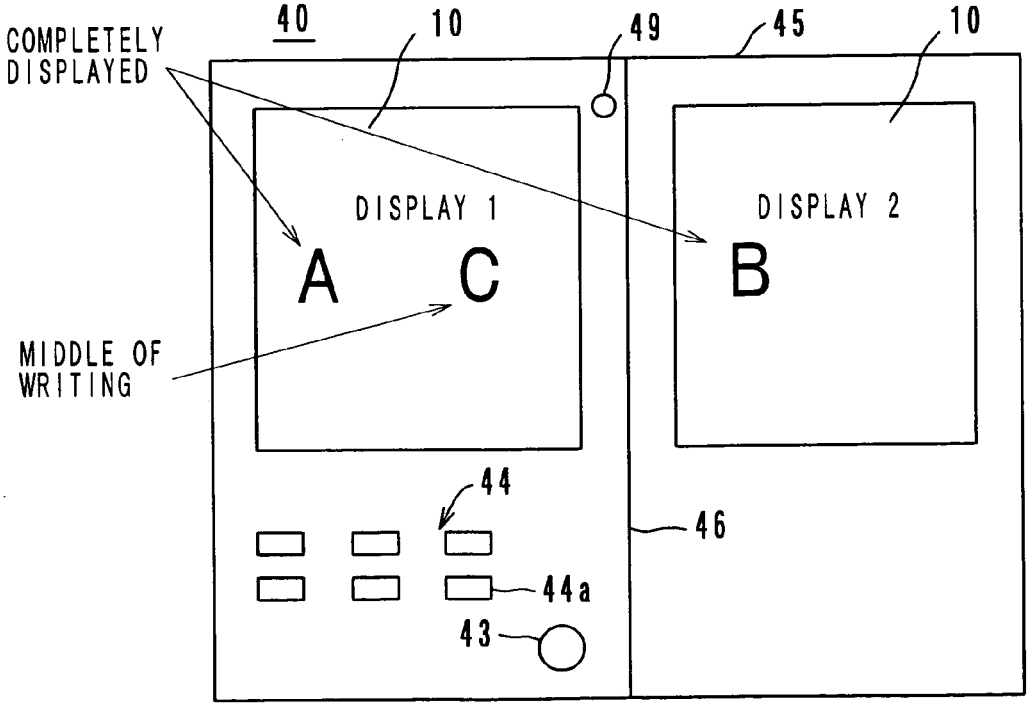
FIG. 21 is a plan view of the electronic book type information display device, showing another exemplary display in the rapid mode.

FIG. 21 shows the electronic book type information display device 40. In the case of FIG. 21, each of the displays 1 and 2 is divided into a left section and a right section. In the sections, images A, B, C . . . are subsequently displayed in the driving method shown by FIG. 11.

Compensation of Quantity of Light

Figure 22:
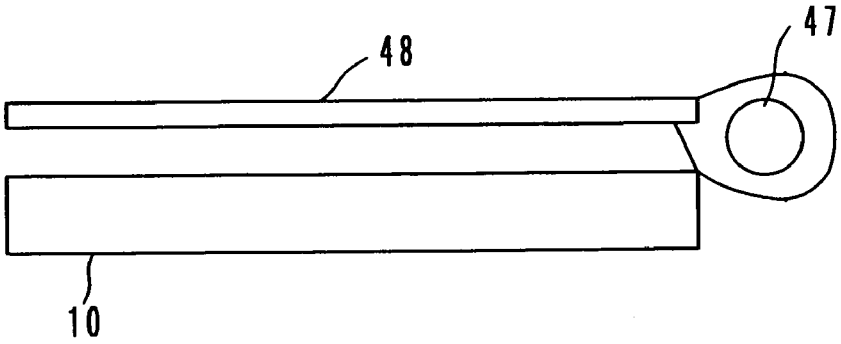
FIG. 22 is a schematic side view of an example of the information display device provided with a front light.

The quantity of reflected light of the liquid crystal display 10 is lowered at night and in a dark room. As FIG. 22 shows, in order to compensate a loss in the quantity of reflected light, a front light 47 and a diffusing plate 48 are provided on the front side of the liquid crystal display 10. The turn-on/turn-off of the front light 47 and regulation of the quantity of light are controlled based on the detection result of a light receiving sensor 49 shown in FIG. 17. When the detection result is lower than a specified value, the quantity of light emitted from the front light 47 is increased, and when the detection result is above the specified value, the quantity of light emitted from the front light 47 is fixed to a low value, or the front light 47 is turned off.

Figure 23:
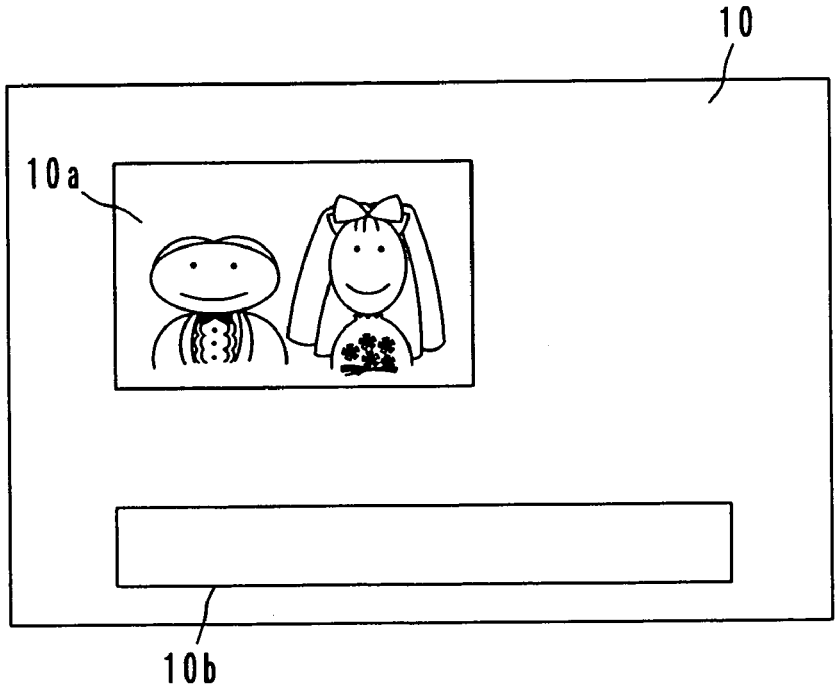
FIG. 23 is an illustration of an exemplary display pattern on the liquid crystal display.

Such control for compensation of quantity of light can be adopted to a wall-type display 10 as shown by FIG. 23 as well as to an electronic book type.

Also, the light receiving sensor 49 may be replaced by a temperature sensor. When the detection result of the temperature sensor is over a specified value, the currently displayed image is once reset, and the same image is written again by a lower voltage than the driving voltage for the previous writing of the image. With respect to the liquid crystal used in this embodiment, the contrast may become too high with a rise in temperature. It is preferred to lower the contrast which has become too high with a rise in temperature. A change in contrast with a change in temperature influences the rapid mode strongly, and this control is especially effective in the rapid mode.

FIG. 23 shows an exemplary displaying method on the liquid crystal display 10. The display 10 is divided into a drawing area 10*a* and a letter area 10*b*, and on the drawing area 10*a*, a display in the rapid mode is made by the phase transition drive method shown by FIG. 8. Generally, the volume of data for a drawing is larger than the volume of data for letters, and data for a drawing can be specified more easily. Therefore, when data for a drawing and data for letters are mixed in an image, the drawing is displayed in the rapid mode prior to the letters. After the drawing to be displayed is determined, the letters describing the drawing are displayed.

Control Procedure in the Rapid Mode

Figure 24:
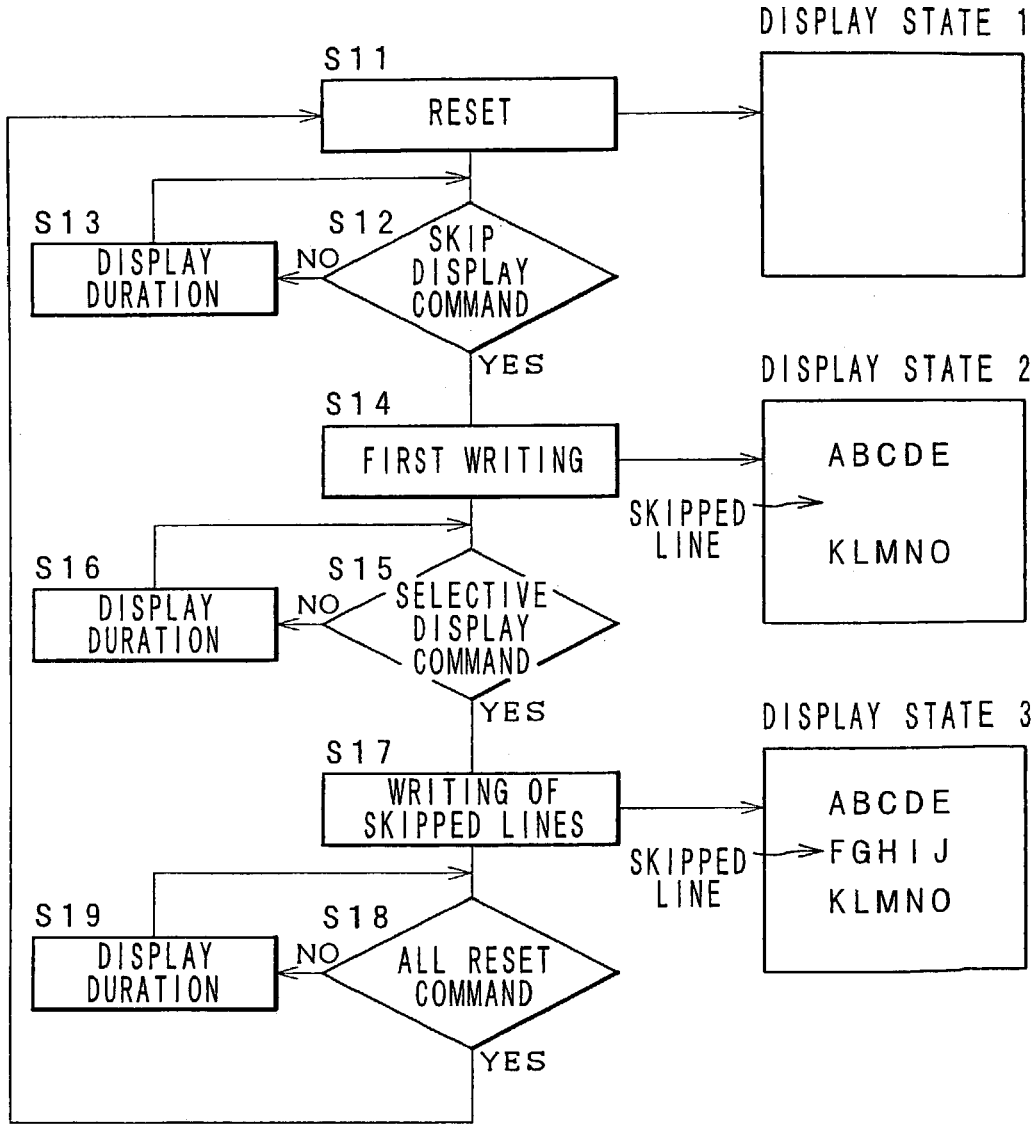
FIG. 24 is a flowchart which shows a control procedure for operation in the rapid mode.

FIG. 24 shows a first exemplary control procedure in the rapid mode. In this control procedure, by cutting one or more lines of literal information (skip display) in displaying one page, the content of the information can be skimmed speedily, and the letters on the display are complete without being deformed.

At step S1, the liquid crystal display 10 is reset (see display state 1). When a skip display command is recognized at step S12, letters in every other line are displayed (see display state 2). When a selective display command is recognized at step S15, the skipped line of letters are displayed at step S17 (see display state 3). Thereby, all the letters in one page are displayed. Next, when an all display reset command is recognized at step S18, the program goes back to step S11 for a reset process. In this control procedure, the display states 1, 2 and 3 are maintained until a skip display command, a selective display command or an all display reset command is issued (see steps S13, S16 and S19).

The skip display may be a display of every three lines or every four lines. This procedure may be so modified that a skip display command of the next page can be received right after step S14.

Figure 25:
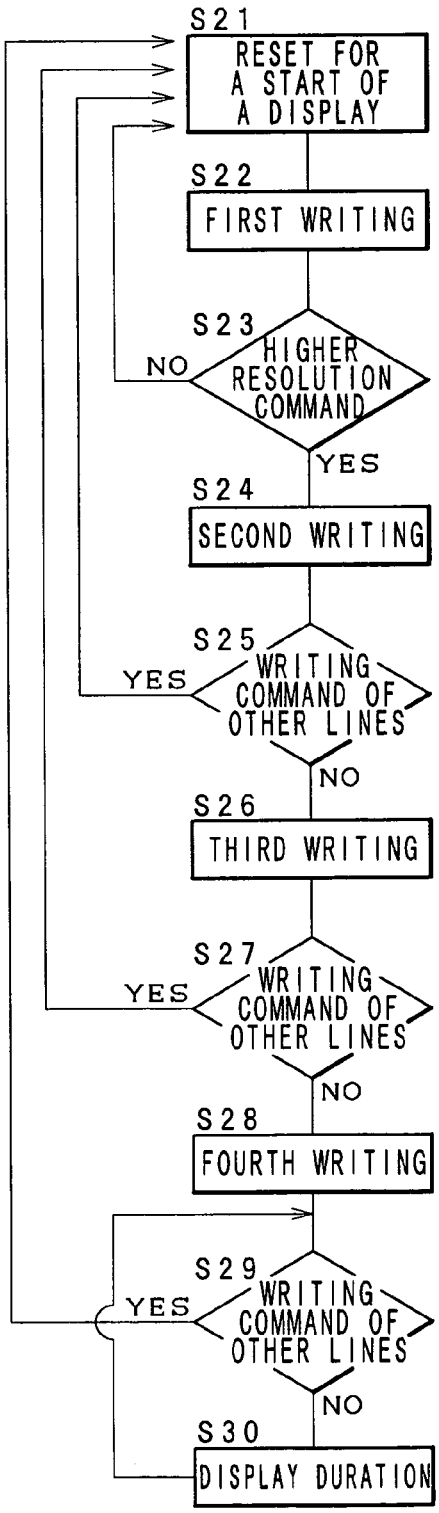
FIG. 25 is a flowchart which shows another control procedure for operation in the rapid mode.

FIG. 25 is a second exemplary control procedure in the rapid mode. In this control procedure, letters on a plurality of selected lines of each page are displayed. After a first writing process, the displayed image is at a low resolution, and as the number of writing processes is increasing, the resolution becomes higher. After a fourth writing process, the image is displayed at a full resolution.

At step S21, the liquid crystal display 10 is reset for a start of a display. At step S22, a first writing process is performed. Here, the first some lines are selected and are displayed at a low resolution. Next, at step S23, it is judged whether or not a higher resolution display has been commanded. Here, if the observer has chosen to see a display of the lines at a higher resolution ("YES" at step S23), a second writing process is performed at step S24, so that the letters on the lines are displayed at a one-step higher resolution. If the observer has chosen to see the next page ("NO" at step S23), the program goes back to step S21, and at step S22, the same writing process of the next page is performed.

Next, when a writing command of other lines is recognized at step S25, the program goes back to step S21 to start writing of the next some lines. When a writing command of other lines is not issued, a third writing process is performed at step S26 to heighten the resolution of the display of the first some lines one step more. In the same way, it is judged at step S27 whether or not a writing command of other lines has been issued. If the command is not recognized, a fourth writing process is performed at step S28, whereby the display of the first some lines is completed at a full resolution. Thereafter, the display at a full resolution is maintained until a writing command of other lines is recognized at step S29.

Information Display System

Figure 26:
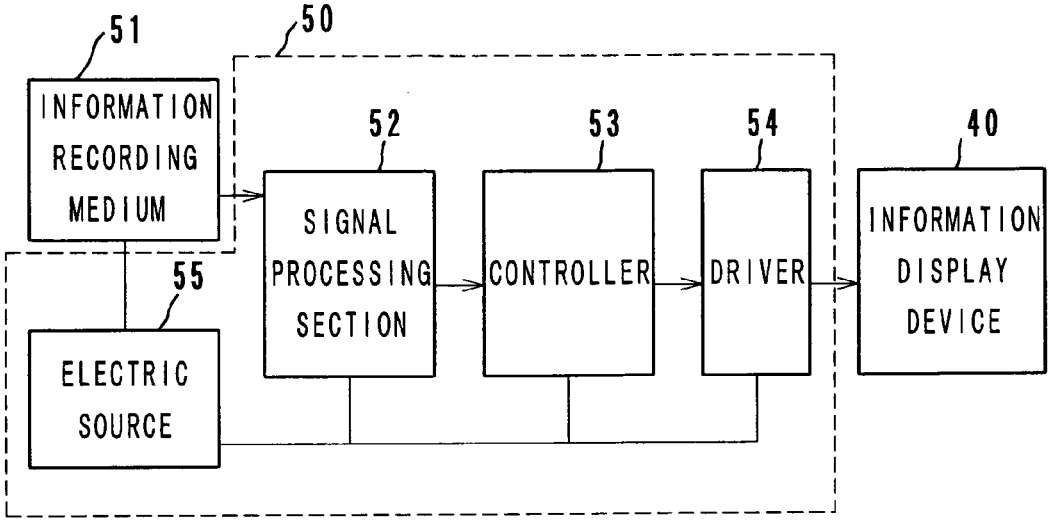
FIG. 26 is a block diagram of a first exemplary information display system.

FIG. 26 shows a first exemplary information display system using the information display device 40. This system is a combination of the information display device 40 and a host device 50 and is of an electronic book type as shown by FIG. 17. The host device 50 comprises a signal processor 52, a controller 53, a driver 54 and an electric source 55. The information recording medium 51 is a conventional recording medium such as a card type memory, a CD-ROM, a magnetic memory or the like. The user purchases or rents the recording medium at a convenience store or the like and inserts the recording medium in the host device 50. From the information recording medium 51, data are inputted to the signal processor 52.

Figure 27:
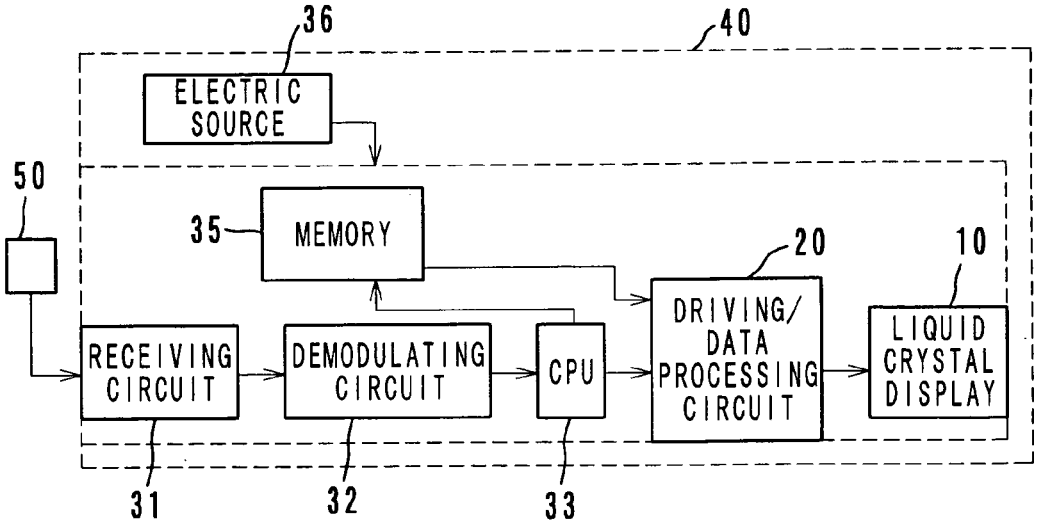
FIG. 27 is a block diagram which shows a control circuit built in an information display device in the system shown by FIG. 26.

The information display device 40 has a circuit shown by FIG. 27. Data transmitted from the driver 54 of the host device 50 are received at a receiving circuit 31, are inputted to a CPU 33 via a demodulating circuit 32 and are stored in a memory 35. The memory 35 is stored with data of a plurality of images. For a display on the liquid crystal display device 10, the data are read out of the memory 35, and the display device 10 is driven by the driving/image signal processing circuit 20. An electric source 36 supplies electricity to the circuits in the display device 40.

Figure 28:
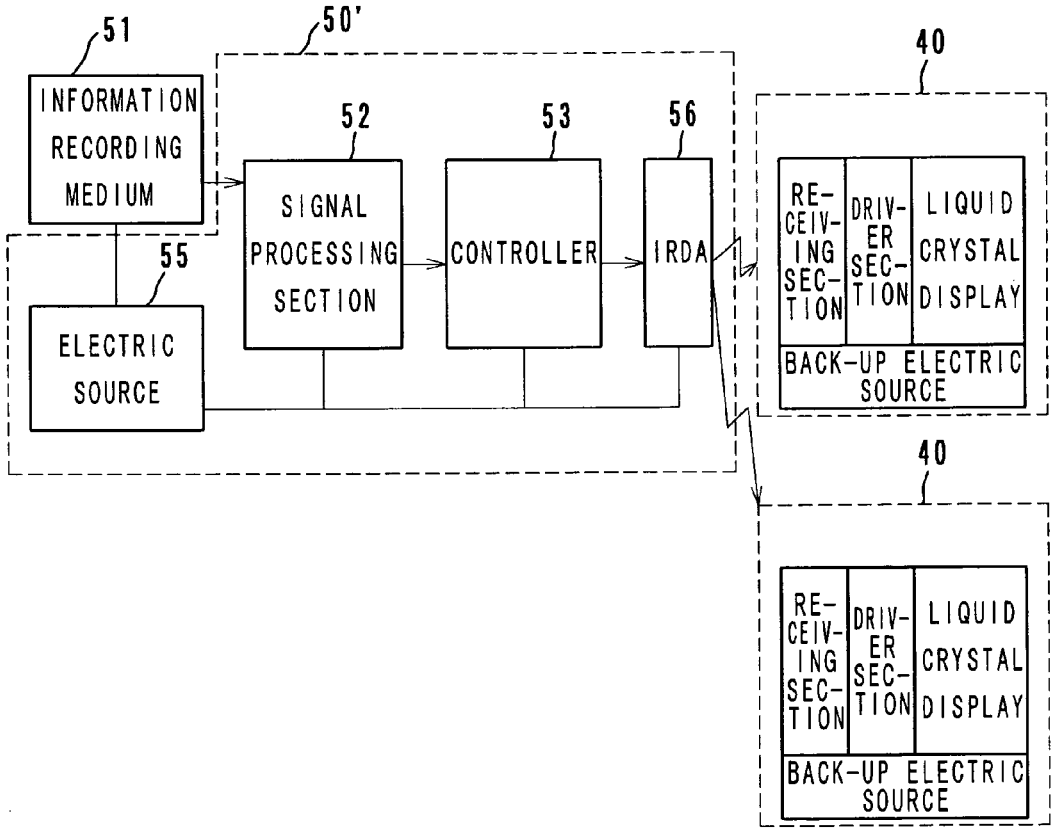
FIG. 28 is a block diagram of a second exemplary information display system.

FIG. 28 shows a second exemplary information display system. In this system, the host device is separated from the information display device. In this system, therefore, from one host device 50', data can be transmitted to a plurality of information display devices 40.

The host device 50' has an IRDA 56 in its output section and transmits data to each of the display devices 40 by remote control. With this system, for example, by installing the host device 50' in a room of a building, data can be transmitted from the host device 50' to a plurality of display devices 40 installed in a plurality of places. In other words, a plurality of users can obtain information from the same source. The IRDA 56 may be replaced by any other communication means such as frequency modulating communication means.

Information Display Device with a Speaker

Figure 29:
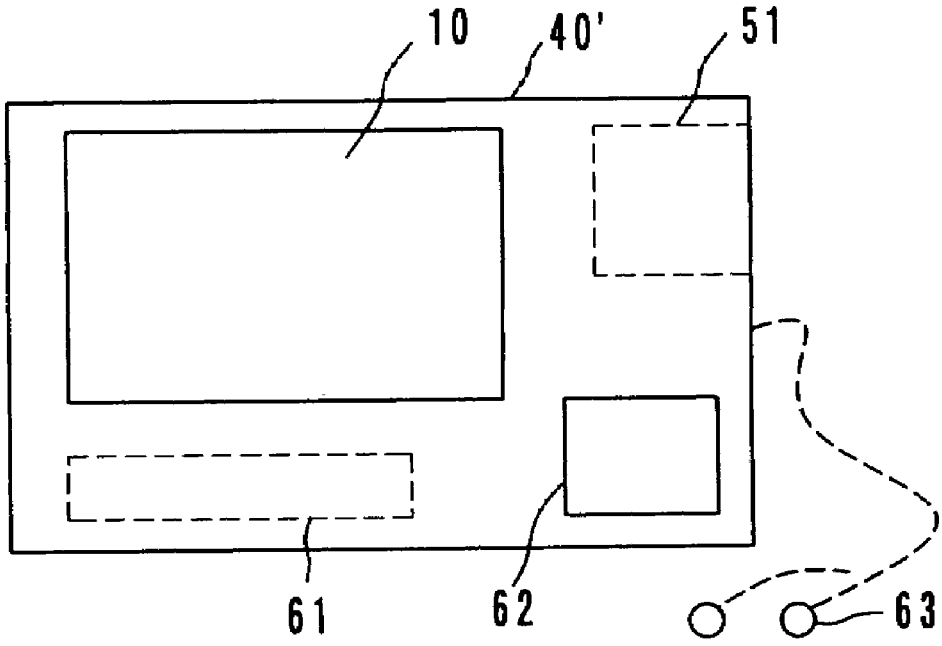
FIG. 29 is a plan view of an information display device provided with a speaker.

FIG. 29 shows an information display device 40' provided with a speaker 61. The speaker 61 is of a film type and is provided under the liquid crystal display 10. Also, in the device 40', the host device 50 is installed, so that an information recording medium 51 can be inserted in the device 40'. An operating section 62 for regulation of the volume and control of a display is integrated with an electric source section and is installed in the device 40'. The speaker 61 outputs audio information stored in the medium 51. In the rapid mode, audio information from the speaker 61 compensates for lack of visual information from the display. The speaker 61 may be so designed to output audio information rapidly in synchronization with visual information in the rapid mode. Further, the speaker 61 may be replaced by a head phone 63, or both the speaker 61 and the head phone 63 may be provided in this device 40'.

Vending System

Figure 30:
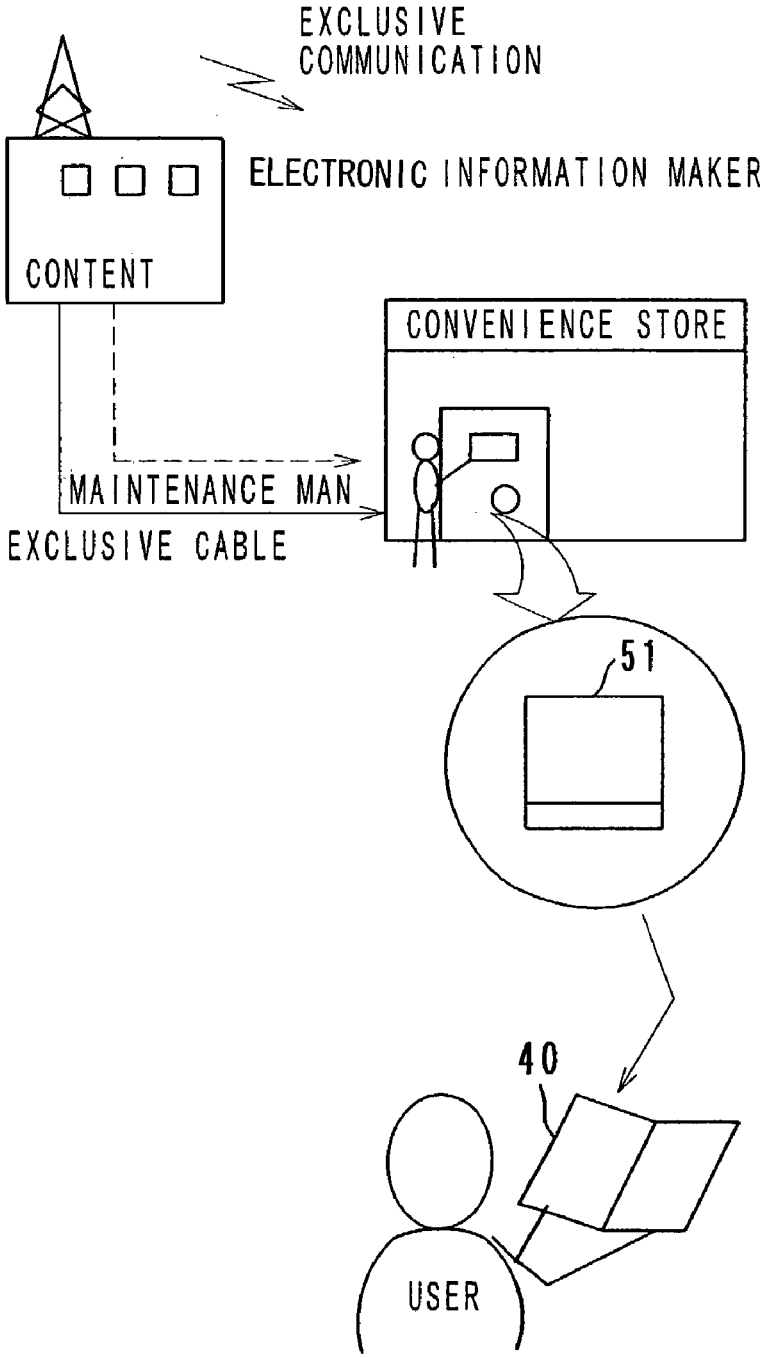
FIG. 30 is an illustration which shows a first exemplary recording media vending system.

FIG. 30 shows a first exemplary vending system to distribute information recording media 51 to users of the information display device 40 shown by FIGS. 17 and 26.

The information recording media 51 are produced by electronic information makers such as publishers and are carried to stores via exclusive cables or exclusive communication using radio waves or by maintenance men. A user purchases or rents such a recording medium at a store. A system wherein a user can store desired information in his/her display device 40 at a store is also possible.

Figure 31:
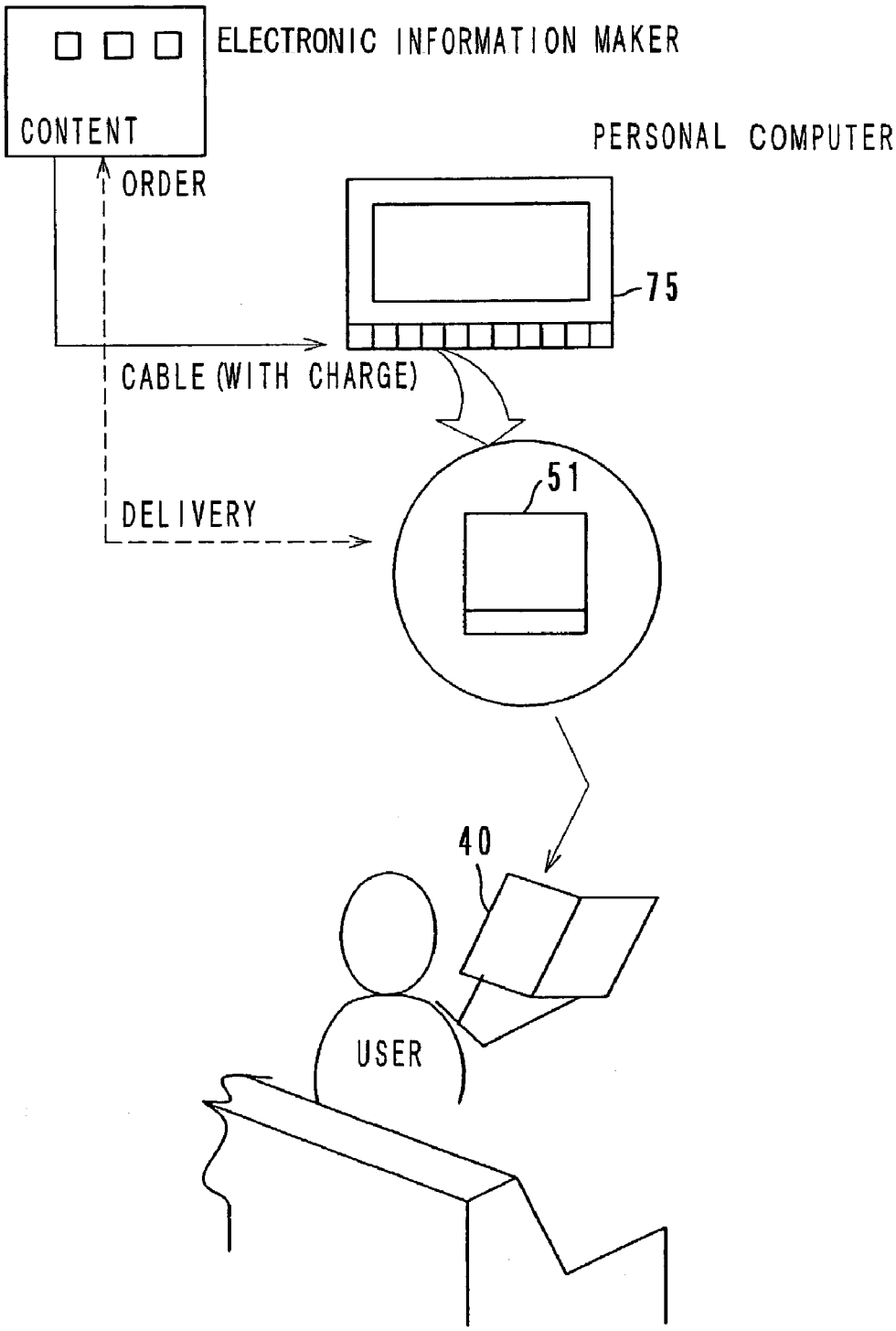
FIG. 31 is an illustration which shows a second exemplary recording media vending system.

FIG. 31 shows a second exemplary vending system. In this vending system, a user orders desired information selected from a catalog or the like, and the electronic information maker transmits the information to the user's personal computer 75 via a cable (phone line). The user outputs the information on the display of the personal computer 75 transmitted thereto or stores the information in his/her recording medium 51 and inputs the information to his/her information display device 40 via the recording medium 51. Also, the electronic information maker may deliver the recording medium 51 to the user.

OTHER EMBODIMENTS

The materials of the liquid crystal and other members and the values which have been given in the above embodiments are merely examples. The above-described display devices and systems can be used in various ways, and various kinds of information can be displayed by use of these devices and systems. A suitable control method shall be adopted depending on the usage.

A plurality of methods can be adopted to drive the liquid crystal display described in the above embodiments. As another driving method which has a different principle, a dynamic drive method for a bistable liquid crystal display disclosed by U.S. Pat. No. 5,748,277 can be also adopted to drive the liquid crystal display described in the above embodiments.

Although the present invention has been described in connection with the preferred embodiments above, it is to be noted that various changes and modifications are possible to those who are skilled in the art. Such changes and modifications are to be understood as being within the scope of the present invention.

What is claimed is:

1. A method for driving a liquid crystal display having a plurality of scan electrodes and a plurality of data electrodes having a memory effect, said method comprising the steps of:

(a) addressing a plurality of said scan electrodes and a plurality of said data electrodes to reset an area of said liquid crystal display defined by the plurality of scan electrodes and the plurality of data electrodes;

(b) addressing at least some of said plurality of scan electrodes sequentially;

(c) addressing selected ones of said data electrodes synchronizing with the sequential addressing of the scan electrodes in the step (b) to form an image; and (d) improving a contrast of said image by repeating the steps (b) and (c) a plurality of times without interposing the step (a), wherein repeating the steps (b) and (c) comprises repeating the steps (b) and (c) as long as image data upon which said image is based remains unchanged and a predetermined number of repetitions have not occurred.

2. A method according to claim 1, wherein the liquid crystal display has a cholesteric liquid crystal material comprising chiral nematic liquid crystal and a plurality of kinds of chiral agents.

3. A method for driving a liquid crystal display having a plurality of scan electrodes and a plurality of data electrodes, said method comprising the steps of:

(a) addressing at least some of said plurality of scan electrodes sequentially;

(b) addressing, in accordance with image data, said data electrodes synchronizing with the sequential addressing of the scan electrodes in the step (a) to dorm an image;

(c) improving a contrast of said image by repeating the steps (a) and (b) a plurality of times; and (d) maintaining said image on said liquid crystal display without applying electrical voltage to any one of said scanning electrodes and data electrodes, wherein repeating the steps (a) and (b) comprises repeating the steps (a) and (b) unless said image data has changed or a predetermined number of repetitions have occurred.

4. A method according to claim 3, wherein the liquid crystal display has a cholesteric liquid crystal material comprising chiral nematic liquid crystal and a plurality of kinds of chiral agents.

5. A display device comprising:

a liquid crystal display having a liquid crystal material with a memory effect;

a driver for applying a pulse voltage to the liquid crystal display to drive the liquid crystal display; and a controller for controlling said driver, when driving the liquid crystal display to display data thereon, to apply a pulse voltage having a pulse width that is a plurality of times shorter than a pulse width which is necessary for displaying the data on the liquid crystal display.

6. A display device according to claim 5, wherein the liquid crystal material is a cholesteric liquid crystal material comprising chiral nematic liquid crystal and a plurality of kinds of chiral agents.

7. A display device according to claim 5, further comprising a temperature sensor, wherein the controller modulates the pulse in accordance with the temperature detected by the temperature sensor.

8. A display device according to claim 5, wherein the controller has an operation mode in which the controller controls the driver to apply a pulse voltage having a pulse width which is necessary for displaying desired data on the liquid crystal.

9. A display device comprising:

a liquid crystal display having a liquid crystal material with a memory effect;

a driver for applying a pulse voltage to the liquid crystal display to drive the liquid crystal display; and a controller for controlling said driver, when driving the liquid crystal display to display data thereon, to apply a plurality of pulse voltages having a pulse width shorter than a pulse width which is necessary for displaying the data on the liquid crystal display.

10. A display device according to claim 9, wherein the liquid crystal material is a cholesteric liquid crystal material comprising chiral nematic liquid crystal and a plurality of kinds of chiral agents.

11. A display device according to claim 9, further comprising a temperature sensor, wherein the controller modulates the pulse in accordance with the temperature detected by the temperature sensor.

12. A display device according to claim 9, wherein the controller has an operation mode in which the controller controls the driver to apply a plurality of pulse voltages each having a pulse width which is necessary for displaying desired data on the liquid crystal.

* * * * *

UNITED STATES PATENT AND TRADEMARK OFFICE

CERTIFICATE OF CORRECTION

PATENT NO. : 6,927,765 B1 
DATED : August 9, 2005
INVENTOR(S) : Naoki Masazumi, Eiji Yamakawa and Hideo Hotomi It is certified that error appears in the above-identified patent and that said Letters Patent is hereby corrected as shown below:

Column 21,
Line 42, delete “to dorm an” and insert -- to form an --.

Column 22,
Line 36, delete “pulse voltages having a pulse” and insert -- pulse voltages each having a pulse --.

Signed and Sealed this

Third Day of January, 2006

JON W. DUDAS
*Director of the United States Patent and Trademark Office*